US005652088A

United States Patent [19]

Yamashita et al.

[11] Patent Number: 5,652,088

[45] Date of Patent: Jul. 29, 1997

[54] SILVER HALIDE PHOTOGRAPHIC MATERIAL

[75] Inventors: Seiji Yamashita; Hirohiko Tsuzuki; Tadashi Ito, all of Minami Ashigara, Japan

[73] Assignee: Fuji Photo Film Co., Ltd., Minami Ashigara, Japan

[21] Appl. No.: 582,160

[22] Filed: Jan. 2, 1996

[30] Foreign Application Priority Data

Jan. 6, 1995 [JP] Japan ..... 7-000607

[51] Int. Cl.[6] ..... G03C 5/17; G03C 1/08

[52] U.S. Cl. ..... 430/448; 430/139; 430/567; 430/600; 430/613; 430/966

[58] Field of Search ..... 430/566, 567, 430/966, 963, 448, 139, 613, 600

[56] References Cited

U.S. PATENT DOCUMENTS

| | | | |
|---|---|---|---|
| 4,732,845 | 3/1988 | Keiji et al. | 430/551 |
| 4,810,623 | 3/1989 | Kokelenberg et al. . | |
| 4,927,744 | 5/1990 | Henzel et al. | 430/566 |
| 4,952,491 | 8/1990 | Nishikawa et al. | 430/570 |
| 4,978,606 | 12/1990 | Ohki et al. | 430/505 |
| 5,283,161 | 2/1994 | Toya et al. | 430/566 |
| 5,451,490 | 9/1995 | Budz et al. | 430/567 |

FOREIGN PATENT DOCUMENTS

| | | |
|---|---|---|
| 50-39928 | 4/1975 | Japan . |
| 57-84448 | 5/1982 | Japan . |

*Primary Examiner*—Thorl Chea

*Attorney, Agent, or Firm*—Burns, Doane, Swecker & Mathis, LLP

[57] ABSTRACT

A silver halide photographic material comprising a transparent support and at least one silver halide emulsion layer provided on at least one side of said transparent support, said at least one silver halide emulsion layer comprising silver halide grains, wherein at least 50% of the total projected area of said silver halide grains accounts for silver chloride-containing tabular grains having a silver chloride content of 20 mol % or more, and the tabular grains have an average aspect ratio of 2 or more, and the silver halide photographic material contains at least one compound represented by formula [I] or (A):

[I]

(A)

The photographic material can reduce pollution caused by developing solutions and fixing solutions, and reduce the replenishment rate thereof.

15 Claims, No Drawings

SILVER HALIDE PHOTOGRAPHIC MATERIAL

FIELD OF THE INVENTION

The present invention relates to a silver halide photographic material containing a tabular grain emulsion high in silver chloride content, and particularly to a silver halide photographic material excellent in processing ability at a low replenishment rate.

BACKGROUND OF THE INVENTION

In general, photographic processing of silver halide photographic materials with automatic processors is conducted by combinations of steps using processing solutions having functions of development, fixing and washing. When a large amount of photographic materials are processed, components consumed by processing and components carried out by inclusion in photographic material films are replenished. On the other hand, in order to remove components eluted in processing solutions by processing of photographic materials or concentrated by evaporation (for example, halogen ions in developing solutions and silver complex salts in fixing solutions), processing solutions are partially discarded by overflowing at the same time that the replenishment is conducted.

Photographic processing effluents which have hitherto been generally used contain environmentally or pollutionally unfavorable components. It is therefore not permitted to discard them into the general drainage system, and they are required to be treated as industrial wastes. In facilities where photographic materials are processed (for example, hospitals, printing companies and mini laboratories), it becomes necessary to request recovery of effluents to professional effluent processors paying recovery fees or to install pollution prevention equipment. Request to the effluent processors necessitates considerable space for pooling the effluents and high recovering cost. Further, installation of the pollution prevention equipment has the disadvantages that extremely high initial investment in the equipment and considerable space for installing the equipment become necessary.

Further, in 1996, it was resolved to prohibit the disposal of industrial wastes at sea as a general rule. Accordingly, the developments of processes for fundamentally reducing the amount of the effluents and means for efficiently treating the effluents are urgently desired, not limited to the problem of effluent recovery in each facility.

On the other hand, the necessity to reduce pollution caused by developing solutions and fixing solutions, namely to reduce or remove environmentally unfavorable components has been increased. In particular, developing solutions have been desired to be easily handled, that is, high in safety and not turned to dark-brown tar-like products even if oxidized.

Further, in order to solve this problem, the techniques of using photographic materials containing developing agents and developing with alkaline solutions substantially free from developing agents are disclosed in *Research Disclosure*, vol. 173, 17364 (1978), JP-A-50-39928 (the term "JP-A" as used herein means an "unexamined published Japanese patent application"), JP-A-57-84448 and JP-A-63-228148. In these techniques, development is required to be conducted with developing solutions having a pH as high as 12 to 14 to obtain sufficient density, so that it is not said to be environmentally favorable processes.

Furthermore, these prior-art techniques have the disadvantage that a large amount of silver is applied to the photographic materials in order to obtain sufficient density, which causes an increase in fixing load, failing to decrease the replenishment rate of fixing solutions.

There are a number of prior-art techniques in reference to tabular grains high in silver chloride content. Examples of the tabular grains having (111) faces as major faces are described in JP-B-64-8326 (the term "JP-B" as used herein means an "examined Japanese patent publication"), JP-B-64-8325, JP-B-64-8324, JP-A-1-250943, JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959.

Prior-art techniques of the tabular grains having (100) faces as major faces are described in JP-A-5-204073, JP-A-51-88017, JP-A-63-24238, etc. In particular, silver chloride-containing (100) tabular grains are described in JP-A-63-24238.

Many examples of photographic materials containing these tabular grains high in silver chloride content are seen, but there is no example in which developing agents are contained therein as the present invention.

Much less, it has not been expected at all that the photographic materials of the present invention are very effective for achievement of the reduced replenishment rate of developing solutions and fixing solutions and the reduced pollution caused thereby in an image forming system in combination with X-ray absorbent fluorescent intensifying screens.

The prior-art techniques are insufficient for achievement of the reduced replenishment rate of developing solutions and fixing solutions and the reduced pollution caused thereby.

SUMMARY OF THE INVENTION

It is therefore an object of the present invention to provide a photographic material which can achieve to reduce pollution caused by developing solutions and fixing solutions and to reduce the replenishment rate thereof.

Another object of the present invention to provide a photographic material which can be developed even with a developing solution substantially free from a developing agent, namely a developing solution reduced in pollution.

According to the present invention, there is provided a silver halide photographic material having at least one silver halide emulsion layer on at least one side of a transparent support, wherein at least 50% of the total projected area of at least one emulsion contained in said emulsion layer is a silver chloride-containing tabular grain emulsion having a silver chloride content of 20% or more, and the tabular grains have an average aspect ratio of 2 or more, and at least one compound represented by the following formula [I] or (A) is contained in the photographic material:

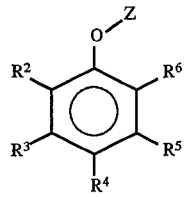

[I]

wherein $R^2$ to $R^6$, which may be the same or different, each represents a hydrogen atom or a group which can be substituted to the benzene ring, with the proviso that the total carbon atom number of $R^2$ to $R^6$ is 8 or more and at least one of $R^2$ and $R^4$ is a hydroxyl group, a sulfonamido group or a carbonamido group; Z represents a hydrogen atom or a protecting group which can be deprotected under alkaline conditions; and $R^2$ to $R^6$ and OZ may combine with each other to form a ring.

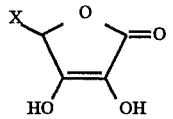

(A)

wherein X represents an aryl group, a heterocyclic group or a group represented by formula (B):

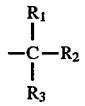

(B)

wherein $R_1$, $R_2$ and $R_3$, which may be the same or different, each represents a hydrogen atom or a group other than a hydroxyl group.

DETAILED DESCRIPTION OF THE INVENTION

Formula [I] is hereinafter described in more detail. Preferred examples of the substituent groups represented by $R^2$ to $R^6$ in formula [I] include a halogen atom (for example, chlorine and bromine), a hydroxyl group, a sulfo group, a carboxyl group, a cyano group, an alkyl group (preferably having 1 to 30 carbon atoms, which may be straight, branched or cyclic, for example, methyl, sec-octyl, t-octyl, hexadecyl and cyclohexyl), an alkenyl group (preferably having 2 to 30 carbon atoms, for example, allyl and 1-octenyl), an alkynyl group (preferably having 2 to 30 carbon atoms, for example, propargyl), an aralkyl group (preferably having 7 to 30 carbon atoms, for example, 1,1-dimethyl-1-phenylmethyl and 3,5-di-t-butyl-2-hydroxyphenylmethyl), an aryl group (preferably having 6 to 30 carbon atoms, for example, phenyl and naphthyl), a heterocyclic group (3- to 12-membered rings containing at least oxygen, nitrogen, sulfur, phosphorus, selenium or tellurium, for example, furfuryl, 2-pyridyl, morpholino, 1-tetrazolyl and 2-selenazolyl), an alkoxy group (preferably having 1 to 30 carbon atoms, for example, methoxy, methoxyethoxy, hexadecyloxy, isopropoxy and allyloxy), an aryloxy group (preferably having 6 to 30 carbon atoms, for example, phenoxy and 4-nonylphenoxy), an alkylthio group (preferably having 1 to 30 carbon toms, for example, butylthio, dodecylthio, 2-hexyldecylthio and benzylthio), an arylthio group (preferably having 6 to 30 carbon atoms, for example, phenylthio), a carbonamido group (preferably having 1 to 30 carbon atoms, for example, acetamido, 2-(2,4-di-t-pentylphenoxy)butaneamido, benzamido and 3,5-bis(2-hexyldecaneamido)benzamido), a sulfonamido group (preferably having 1 to 30 carbon atoms, for example, methanesulfonamido, 4-(2,4-di-t-pentylphenoxy) butanesulfonamido, benzenesulfonamido and 4-dodecyloxybenzenesulfonamido), a ureido group (preferably having 1 to 30 carbon atoms, for example, N'-octadecylureido, N'-[3-(2,4-di-t-pentylphenoxy)propyl] ureido, N'-(4-cyanophenyl)ureido and N'-(2-tetradecyloxyphenyl)-ureido), an alkoxycarbonylamino group (preferably having 2 to 30 carbon atoms, for example, benzyloxycarbonylamino and ethoxy-carbonylamino), an aryloxycarbonylamino group (preferably having 7 to 30 carbon atoms, for example, phenoxycarbonylamino), an acyloxy group (preferably having 1 to 30 carbon atoms, for example, acetoxy, dichloroacetoxy, 4-oxopentanoyloxy, 2-(2,4-di-t-pentyl-phenoxy)hexanoyloxy, benzoyloxy and nicotinoyloxy), a sulfamoylamino group (preferably having 30 or less carbon atoms, for example, N'-benzyl-N'-methylsulfamoylamino and N'-phenyl-sulfamoylamino), a sulfonyloxy group (preferably having 1 to 30 carbon atoms, for example, methanesulfonyloxy and benzenesulfonyl-oxy), a carbamoyl group (preferably having 1 to 30 carbon atoms, for example, N-dodecylcarbamoyl, N-[3-(2,4-di-t-pentylphenoxy)-propyl]carbamoyl and N-[2-chloro-5-(1-dodecyloxycarbonyl-ethyloxycarbonyl)phenyl]carbamoyl), a sulfamoyl group (preferably having 30 or less carbon atoms, for example, ethylsulfamoyl, hexadecylsulfamoyl, 4-(2,4-di-t-pentylphenoxy)butylsulfamoyl and phenylsulfamoyl), an acyl group (preferably having 1 to 30 carbon atoms, for example, acetyl, octadecanoyl and benzoyl), a sulfonyl group (preferably having 1 to 30 carbon atoms, for example, methanesulfonyl, octadecanesulfonyl, benzenesulfonyl and 4-dodecylbenzene-sulfonyl), an alkoxycarbonyl group (preferably having 2 to 30 carbon atoms, for example, ethoxycarbonyl, dodecyloxycarbonyl and benzyloxycarbonyl) and an aryloxycarbonyl group (preferably having 7 to 30 carbon atoms, for example, phenoxycarbonyl). These groups may be further substituted by the groups described above.

Then, Z of formula [I] is described. Z is a hydrogen atom or a protecting group which can be deprotected under alkaline conditions. Examples of the protecting groups represented by Z include an acyl group (for example, acetyl, chloroacetyl, dichloroacetyl, benzoyl, 4-cyanobenzoyl and 4-oxopentanoyl), an oxycarbonyl group (for example, ethoxycarbonyl, phenoxycarbonyl and 4-methoxybenzyloxycarbonyl), a carbamoyl group (for example, N-methylcarbamoyl, N-(4-nitrophenyl)carbamoyl, N-(2-pyridyl)carbamoyl and N-(1-imidazolyl)carbamoyl) and protecting groups described in JP-A-59-197037, JP-A-59-201057, JP-A-59-108776 and U.S. Pat. No. 4,473,537. When OZ and $R^2$ to $R^6$ combine with each other to form rings, it is preferred that OZ and $R^2$; $R^2$ and $R^3$; $R^3$ and $R^4$; $R^4$ and $R^5$; $R^5$ and $R^6$; or $R^6$ and OZ combine with each other to form a saturated or unsaturated 4- to 8-membered carbon ring or a saturated or unsaturated 4- to 8-membered heterocyclic ring. In this case, examples thereof are enumerated as follows:

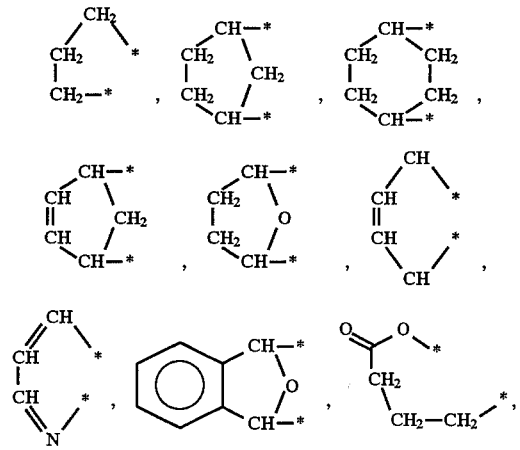

-continued

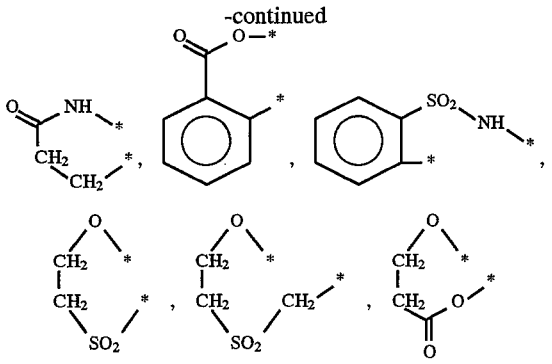

wherein "* mark" indicates the position at which it is joined to the benzene ring of formula [I].

The compounds represented by formula [I] may form bis forms, tris forms, oligomers and polymers. The total carbon atom number of $R^2$ to $R^6$ of formula [I] is preferably 8 or more. The upper limit of the total carbon number of $R^2$ to $R^6$ is preferably 40.

Of the compounds represented by formula [I], compounds represented by the following formulas [II] to [V] are preferred.

[II]

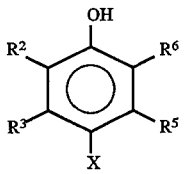

wherein X represents a hydroxyl group or a sulfonamido group, and $R^2$, $R^3$, $R^5$ and $R^6$ each has the same meaning as given in formula [I].

[III]

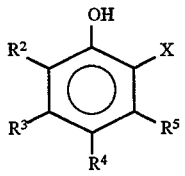

wherein X represents a hydroxyl group or a sulfonamido group, and $R^2$ to $R^5$ each has the same meaning as given in formula [I].

[IV]

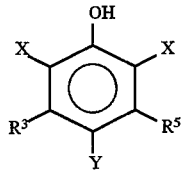

wherein X represents a hydroxyl group or a sulfonamido group, Y represents a carbamoyl group, an oxycarbonyl group, an acyl group or a sulfonyl group, and $R^3$ and $R^5$ each has the same meaning as given in formula [I].

[V]

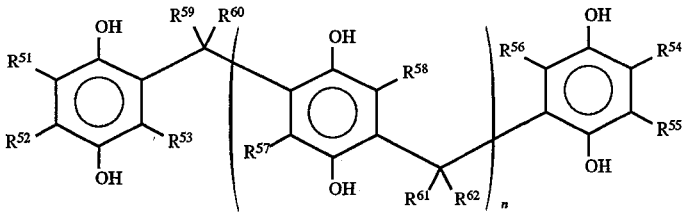

wherein $R^{51}$ to $R^{58}$ each has the same meaning as $R^2$ given in formula [I], $R^{59}$ to $R^{62}$ each represents a hydrogen atom, an alkyl group, an aryl group or a heterocyclic group, and n is an integer of 0 to 50.

In formula [II], $R^2$, $R^3$, $R^5$ and $R^6$ are each preferably a hydrogen atom, a halogen atom, a sulfo group, an alkyl group, an ether group, a thioether group, a carbonamido group, a sulfonamido group, a ureido group, a sulfonyl group, a carbamoyl group or an acyl group, and more preferably a hydrogen atom, a halogen atom, a sulfo group, an alkyl group, a carbonamido group, a sulfonamido group or a sulfonyl group. Most preferably, one of $R^2$ and $R^5$ is an alkyl group, a carbonamido group or a sulfonamido group, and the other is a hydrogen atom, a sulfo group,a sulfonyl group or an alkyl group. X is preferably a hydroxyl group.

In formula [III], $R^2$ to $R^5$ are each preferably a hydrogen atom, an alkyl group, an ether group, a thioether group, a carbonamido group, a sulfonamido group, a ureido group, a sulfonyl group, a carbamoyl group, an oxycarbonyl or an acyl group, more preferably a hydrogen atom, an alkyl group, an ether group, a thioether group, a carbonamido group or a sulfonamido group, and most preferably a hydrogen atom, an alkyl group or an ether group. $R^3$ and $R^4$ are each preferably a hydrogen atom, an alkyl group, a halogen atom or an ether group, more preferably a hydrogen atom or an alkyl group, and most preferably a hydrogen atom. X is preferably a hydroxyl group.

In formula [IV], X is preferably a hydroxyl group, and Y is preferably a carbamoyl group or an oxycarbamoyl group.

In formula [V], $R^{51}$ to $R^{58}$ are each preferably a hydrogen atom, a halogen atom, an alkyl group, an ether group, a thioether group, a carbonamido group, a sulfonamido group, a sulfonyl group, an acyl group or a carbamoyl group, more preferably a hydrogen atom, a halogen atom, an alkyl group, a carbonamido group, a sulfonamido group, an ether group or a thioether group, and most preferably a hydrogen atom, a halogen atom, an alkyl group or a carbonamido group. When n is 0, $R^{52}$ and $R^{54}$ are each preferably an alkyl group, a carbonamido group or a sulfonamido group. When n is an integer other than 0, $R^{52}$ and $R^{54}$ are each preferably a hydrogen atom. n is preferably 0 or an integer of 20 to 50.

Examples of the compounds represented by formula [I] in the present invention are enumerated below, but are not limited thereto.
(I-1)
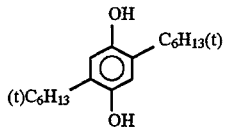
(I-2)
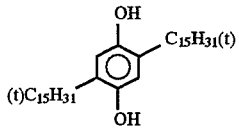
(I-3)
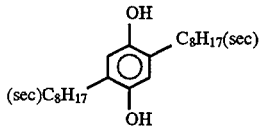
(I-4)
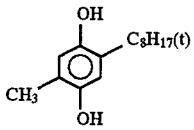
(I-5)
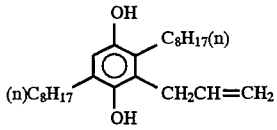
(I-6)
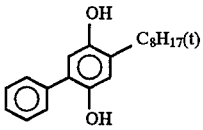
(I-7)
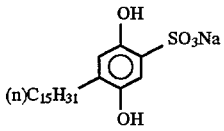
(I-8)
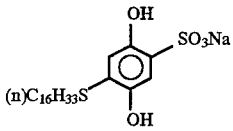
(I-9)
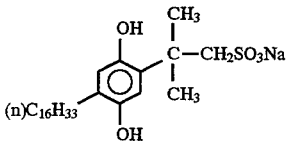
(I-10)
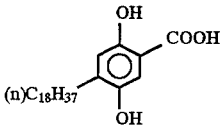
(I-11)
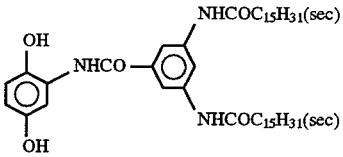
-continued
(I-12)
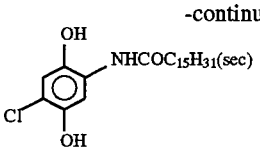
(I-13)
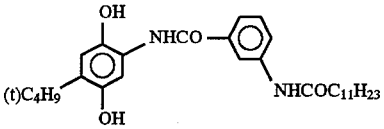
(I-14)
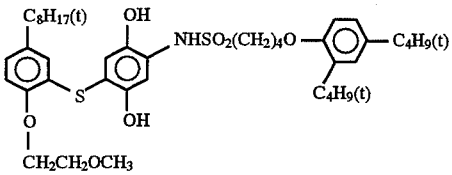
(I-15)
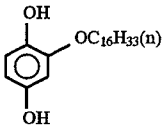
(I-16)
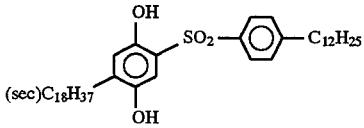
(I-17)
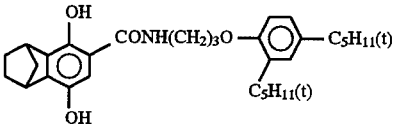
(I-18)
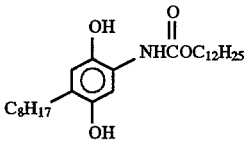
(I-19)
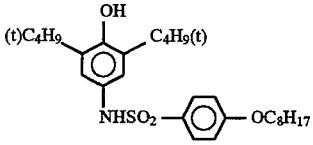
(I-20)
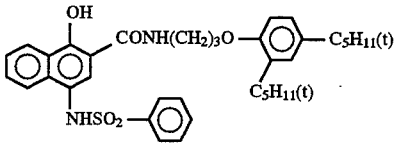
(I-21)
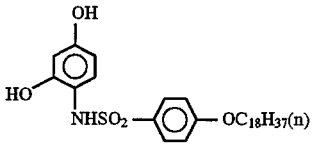
(I-22)
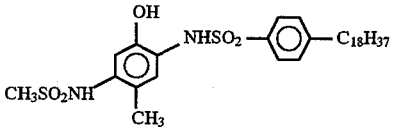

-continued (I-23)

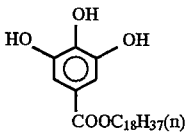

(I-24)

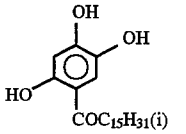

(I-25)

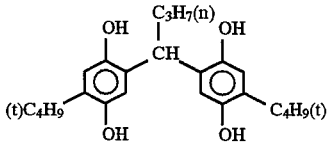

(I-26)

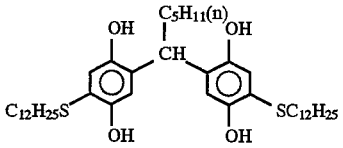

(I-27)

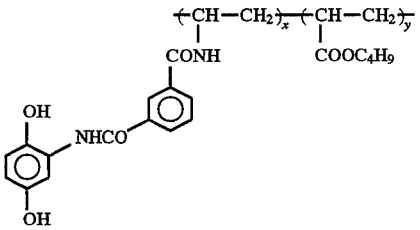

(x:y = 2/5, average molecular weight: about 20,000)

(I-28)

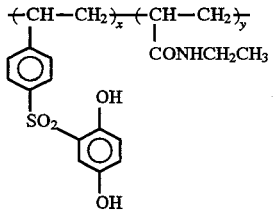

(x:y = 1/2.5, average molecular weight: about 23,000)

(I-29)

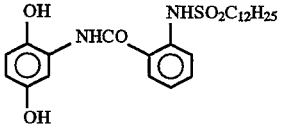

(I-30)

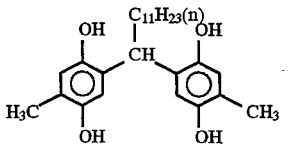

The compounds represented by formula [I] in the present invention can be synthesized by methods described in patents shown below and patents cited therein, and methods based thereon.

Of the compounds represented by formula [II], monoalkyl-substituted hydroquinones are described in U.S. Pat. Nos. 2,360,290, 2,419,613, 2,403,721, 3,960,570 and 3,700,453, JP-A-49-106329 and JP-A-50-156438; dialkyl-substituted hydroquinones are described in U.S. Pat. Nos. 2,728,659, 2,732,300, 3,243,294 and 3,700,453, JP-A-50-156438, JP-A-53-9528, JP-A-53-55121, JP-A-54-29637 and JP-A-60-55339; hydroquinonesulfonates are described in U.S. Pat. No. 2,701,197, JP-A-60-172040, JP-A-61-48855 and JP-A-61-48856; amidohydroquinone derivatives are described in U.S. Pat. Nos. 4,198,239 and 4,732,845, JP-A-62-150346 and JP-A-63-309949; and hydroquinones having electron withdrawing groups are described in JP-A-55-43521, JP-A-56-109344, JP-A-57-22237 and JP-A-58-21249.

The compounds represented by formula [III] are described in U.S. Pat. Nos. 4,447, 523, 4,525,451, 4,530, 899, 4,584,264 and 4,717,651, JP-A-59-220733, JP-A-61-169845, JP-B-62-1386 and West German Patent 2,732,971, the compounds represented by formula [IV] are described in U.S. Pat. Nos. 4,474,874 and 4,476,219 and JP-A-59-133544, and the compounds represented by formula [V] are described in U.S. Pat. Nos. 2,710,801, 2,816,028 and 4,717,651, JP-A-57-17949, JP-A-61-169844, Japanese Patent Application Nos. 62-258696 and 63- 234895, JP-A-1-134448, JP-A-1-134447, JP-A-1-206337, JP-A-2-64631 and JP-A-2-90153.

Further, alkali precursors of hydroquinone are described in U.S. Pat. No. 4,443,537 and JP-A-59-108776.

Formula (A) is hereinafter described in detail.

The aryl group represented by X in the formula is an aryl group preferably having 6 to 10 carbon atoms such as phenyl or naphthyl. This group may have a substituent group. The substituent groups include alkyl, alkenyl, aryl, halogen atoms, nitro, hydroxyl, alkoxyl, aryloxy, alkylthio, arylthio, acyloxy, amino, alkylamino, carbonamido, sulfonamido, ureido, acyl, oxycarbonyl, carbamoyl, sulfinyloxy, carboxyl (containing salts thereof), sulfo (containing salts thereof) and hydroxyamino. Preferred examples thereof include phenyl, p-methylphenyl, p-bromophenyl, anisyl, p-carboxyphenyl and p-phosphonylphenyl.

The heterocyclic group represented by X in the formula is a 5- or 6-membered heterocyclic group containing a carbon atom, a nitrogen atom, oxygen atom or a sulfur atom, such as furyl, benzofuryl, pyranyl, pyrrolyl, imidazolyl, pyrazolyl, triazolyl, pyridyl, pyrimidyl, pyridazyl, thienyl or isothiazolyl. These groups may have substituent groups, and the substituent groups described above for the aryl group can be used as such substituent groups. Preferred examples thereof include furyl, 5-methylfuryl, benzofuryl, pyridyl, 5-chloropyridyl, 3-carboxypyridyl, 5-sulfonylpyridyl and 1-phenyltriazolyl.

Then, $R_1$, $R_2$ and $R_3$ of the above-mentioned formula (B) are hereinafter described in detail.

$R_1$, $R_2$ and $R_3$ may be the same or different, and each represents a hydrogen atom or a substituent group other than a hydroxyl group. More particularly, examples of the substituent groups of $R_1$, $R_2$ and $R_3$ include alkyl, aryl, alkoxyl, aryloxy, alkylthio, arylthio, acyloxy, amino, alkylamino, carbonamido, sulfonamido, ureido, oxycarbonyl, carbamoyl, sulfinyloxy, carboxyl (containing salts thereof) and sulfo (containing salts thereof). These groups may be further substituted if possible, and the substituent groups described above for the aryl group can be used as such substituent groups.

Examples of the substituent groups of $R_1$, $R_2$ and $R_3$ are shown in more detail. The alkyl groups are straight, branched or cyclic alkyl groups each having 1 to 16, preferably 1 to 6 carbon atoms, which may have a substituent group(s). The substituent groups described above for the aryl group can be used as such substituent groups. Examples thereof include methyl, ethyl, propyl, isopropyl, butyl, t-butyl, cyclohexyl, benzyl, hydroxymethyl, heptyloxymethyl, phenoxy-methyl, octylthiophenyl, phenylthiomethyl, octanoyloxymethyl, 1,2-dioctanoyloxyethyl, 1,2,3-tridecanoyloxypropyl, aminomethyl, dimethylaminomethyl, octanoylamidomethyl, methanesulfonylamidomethyl, ureidomethyl, undecyloxycarbonylmethyl, carbamoylmethyl, carboxymethyl and sulfonylmethyl.

The aryl groups are aryl groups each having 6 to 10 carbon atoms, which may have a substituent group(s). The substituent groups described above for the aryl group can be used as such substituent groups. Examples thereof include phenyl, naphthyl and p-methylphenyl. The alkoxyl groups are alkoxyl groups each having 1 to 19 carbon atoms, preferably 7 to 19 carbon atoms, which may have a substituent group(s). The substituent groups described above for the aryl group can be used as such substituent groups. Examples thereof include methoxy, ethoxy, propoxy, hexyloxy, heptyloxy, octyloxy, dodecyloxy, octadecyloxy and 2-methoxyethoxy.

The aryloxy groups are aryloxy groups each having 6 to 10 carbon atoms, which may have a substituent group(s). The substituent groups described above for the aryl group can be used as such substituent groups. Examples thereof include phenoxy, p-hydroxyphenoxy, o-carboxyphenoxy and o-sulfonylphenoxy. The alkylthio groups are alkylthio groups each having 1 to 16 carbon atoms, preferably 7 to 16 carbon atoms, which may have a substituent group(s). The substituent groups described above for the aryl group can be used as such substituent groups. Examples thereof include methylthio, octylthio and dodecylthio. The arylthio groups are arylthio groups each having 6 to 10 carbon atoms, which may have a substituent group(s). The substituent groups described above for the aryl group can be used as such substituent groups. Examples thereof include phenylthio, 4-hydroxyphenylthio and 4-octyloxyphenylthio. The acyloxy groups are acyloxy groups each having 1 to 19 carbon atoms, preferably 7 to 19 carbon atoms, which may have a substituent group(s). The substituent groups described above for the aryl group can be used as such substituent groups. Examples thereof include acetoxy, octanoyloxy, hexadecanoyloxy, carboxyacetoxy and 2-sulfonylhexadecanoyloxy.

The alkylamino groups are alkylamino groups each having 1 to 16 carbon atoms, such as dimethylamino and diethylamino. The carbonamido groups are carbonamido groups each having 1 to 16 carbon atoms, such as acetamido and propionamido. The sulfonamido groups are sulfonamido groups each having 1 to 16 carbon atoms, such as methanesulfonamido. The ureido groups are ureido groups each having 1 to 16 carbon atoms, such as ureido and methylureido. The oxycarbonyl groups are oxycarbonyl groups each having 1 to 16 carbon atoms, such as methoxycarbonyl, ethoxycarbonyl and undecyloxycarbonyl. The carbamoyl groups are carbamoyl groups each having 1 to 16 carbon atoms, such as carbamoyl and N,N-dimethylcarbamoyl. The sulfinyloxy groups are sulfinyloxy groups each having 1 to 16 carbon atoms, such as methanesulfinyloxy.

These substituent groups may be further substituted if possible.

Preferred examples of $R_1$, $R_2$ and $R_3$ of the above-mentioned formula (B) include a hydrogen atom, an alkyl group, an alkoxyl group, an aryloxy group, an alkylthio group, an acyloxy group, an oxycarbonyl group and a sulfinyloxy group.

Of the compounds represented by formula (A), compounds represented by the following formula (C) are particularly preferred:

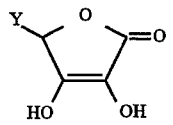

(C)

wherein Y represents a hydrogen atom or a group represented by formula (D):

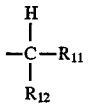

(D)

wherein $R_{11}$ and $R_{12}$, which may be the same or different, each represents a hydrogen atom, an alkyl group, an alkoxyl group, an acyloxy group or an oxycarbonyl group.

Preferred combinations of $R_{11}$ and $R_{12}$ of formula (D) are described below.

In combinations of $R_{11}$ and $R_{12}$, it is preferred that $R_{11}$ is a hydrogen atom, an alkoxyl group or an acyloxy group, and $R_{12}$ is a hydrogen atom, an alkyl group or an oxycarbonyl group.

In these combinations, the alkyl group of $R_{12}$ includes an alkyl group substituted by another substituent group, more preferably an alkyl group substituted by an alkoxyl group or an acyloxy group. These substituent groups may be further substituted if possible.

It is more preferred that $R_{11}$ is an alkoxyl group or an acyloxy group and $R_{12}$ is an alkyl group substituted by an alkoxyl group or an acyloxy group. It is particularly preferred that the alkoxyl group and the acyloxy group each has 7 to 19 carbon atoms, and it is most preferred that the alkyl group of $R_{12}$ is a methyl group. These substituent groups may be further substituted if possible, and the substituent groups described above for the aryl group can be used as such substituent groups.

Of the compounds represented by formula (C), compounds represented by the following formula (E) are most preferred:

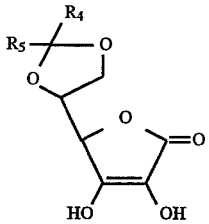

(E)

wherein $R_4$ and $R_5$, which may be the same or different, each represents a hydrogen atom, an alkyl group, an aryl group or an alkenyl group, and the alkyl groups represented by $R_4$ and $R_5$ may combine with each other to form a ring structure. The alkyl group, the aryl group and the alkenyl group include ones substituted by other substituent groups, which include alkyl, alkenyl, aryl, halogen atoms, nitro, hydroxyl, alkoxyl, acyl, carboxyl (containing salts thereof), sulfo (containing salts thereof) and hydroxyamino.

$R_4$ and $R_5$ of formula (E) are each preferably a hydrogen atom, an alkyl group having 6 to 18 carbon atoms, an aryl group having 6 to 10 carbon atoms or an alkenyl group having 6 to 18 carbon atoms, more preferably a hydrogen atom, an alkyl group having 6 to 18 carbon atoms or an aryl group having 6 to 10 carbon atoms, and most preferably a hydrogen atom or an alkyl group having 6 to 18 carbon atoms. The alkyl groups represented by $R_4$ and $R_5$ may combine with each other to form a ring structure, and it is preferred that at least one is not a hydrogen atom. These groups may have substituent groups, and the substituent groups described above for formula (E) can be used as such substituent groups. Examples thereof include hydrogen, methyl, ethyl, propyl, heptyl, undecyl, benzyl, phenyl, chloromethyl, methoxymethyl, 2-methoxyethyl, 1-hydroxyamino-l-methyl-methyl, 9-decenyl, and a cyclopentyl ring and a cyclohexyl ring formed by combination of the alkyl groups represented by $R_4$ and $R_5$. These groups may be further substituted if possible.

The compounds represented by formula (A) are described in the so-called enol form, but compound in the keto form to which they are isomerized are actually identical thereto. In the present invention, therefore, compounds in which hydrogen atoms are isomerized are also included in the scope of the claims.

Examples of the compounds used in the present invention include but are not limited to the following compounds:

A-1

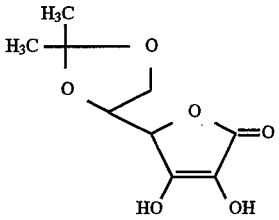

A-2

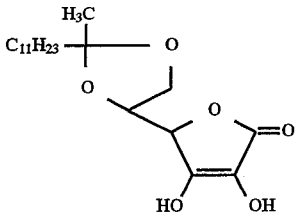

A-3

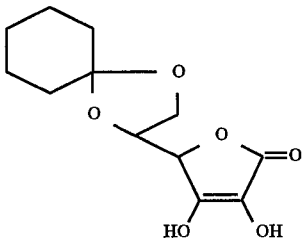

A-4

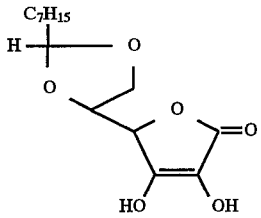

A-5

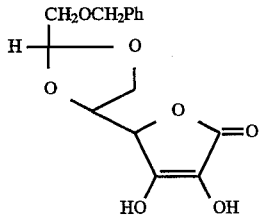

-continued

A-6

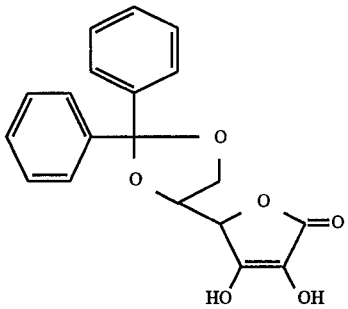

A-7

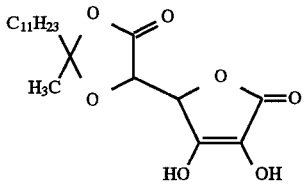

A-8

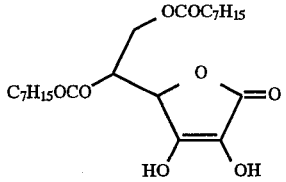

A-9

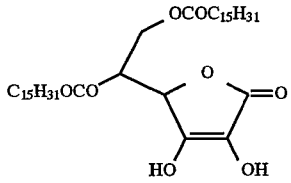

A-10

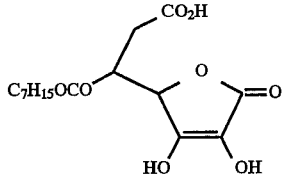

A-11

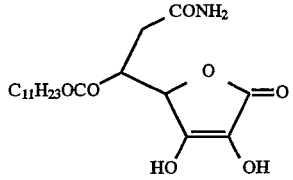

A-12

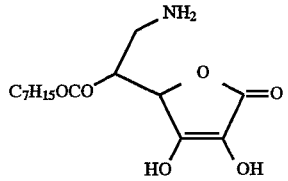

A-13

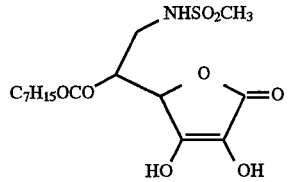

-continued

A-14

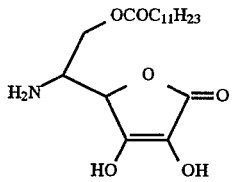

A-15

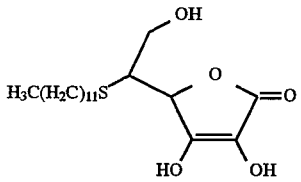

A-16

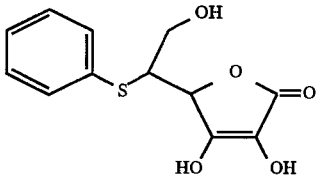

A-17

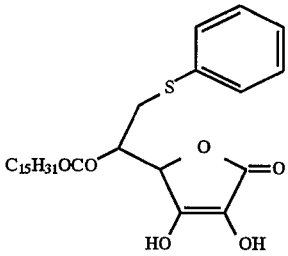

A-18

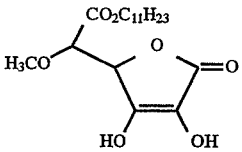

A-19

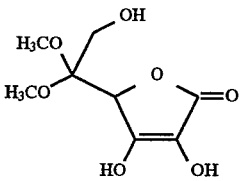

A-20

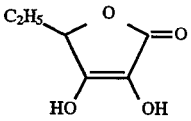

A-21

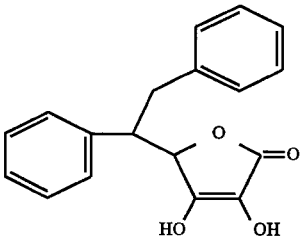

-continued

A-22

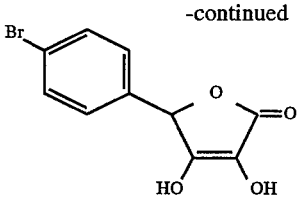

A-23

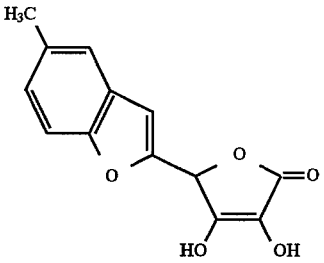

A-24

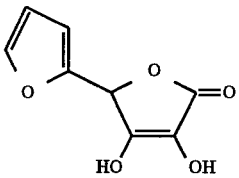

The compounds represented by formula (A) can be synthesized by methods based on the general synthesis methods described in H. Tanaka and K. Yamamoto, *Yakugaku Zasshi*, vol. 86(5), pp. 376–383, E. S. H. EL. Ashry, A. Mousaad and N. Rashed, *Advances in Heterocyclic Chemistry*, vol. 53, pp. 233–302, JP-A-64-45383, JP-A-2-288872, JP-A-4-29985, JP-A-4-364182 and JP-A-5-112594.

The compounds represented by formula [I] or (A) can be added to layers of the photographic materials, for example, light-sensitive emulsion layers, intermediate layers therebetween, protective layers, antihalation layers or other light-insensitive layers, and preferably to the emulsion layers or layers adjacent thereto.

The amount of the compound of formula [I] or (A) added is 0.01 to 10 mol, preferably 0.05 to 2 mol, and more preferably 0.1 to 1 mol, per mol of silver halide contained in a silver halide emulsion layer.

The compounds of formula [I] or (A) may be used alone or as a combination of two or more of them.

The compounds represented by formula [I] or (A) are excellent in performance as developing agents, and reduced in side effects such as generation of colored materials during storage and development or after development, fog and changes in sensitivity. The smaller amount of the compounds are required for effective results, which results in formation of thinner layers.

The compounds represented by formula [I] or (A) are preferably added to coating solutions for the photographic materials as organic solvent solutions, gelatin emulsions or solid dispersions of finely divided particles.

Methods for preparing the gelatin emulsions include methods which comprise dissolving the compounds represented by formula [I] or (A), melting point lowering agents, and high boiling organic solvents and/or polymers in water-insoluble (the solubility in water is 30% or less) low boiling organic solvents, and dispersing the resulting solutions in aqueous phases for emulsification (at this time, gelatin and emulsifying auxiliaries such as surfactants may be used as required). Further, it is preferred from the viewpoint of storage stability that unnecessary organic solvents are removed after addition of said compounds and melting temperature lowering agents to finely divided polymer particles.

Furthermore, they may be dispersed for emulsification without use of the high boiling organic solvents or the polymers.

Emulsified dispersions used in the present invention are prepared in the following manner.

The compounds represented by formula [I] or (A) and high boiling organic solvents are both completely dissolved in low boiling organic solvents, and then the resulting solutions are dispersed in water, preferably in aqueous solutions of hydrophilic colloids, more preferably in aqueous solutions of gelatin, to the form of finely divided particles by use of dispersing auxiliaries such as surfactants if necessary with ultrasonic waves, colloid mills or dissolvers, followed by addition to coating solutions.

It is preferred in respect to storage stability of the dispersions thus prepared that the low boiling organic solvents are removed from the dispersions. Methods for removing the low boiling organic solvents include heating distillation under reduced pressure, heating atmospheric distillation in a gas atmosphere of nitrogen, argon or the like, noodle washing and ultrafiltration.

The high boiling organic solvents as used herein mean organic solvents which are substantially insoluble in water and do not evaporate in the coating and drying steps of the photographic materials, such as phosphates (for example, tricresyl phosphate, triphenyl phosphate, etc.), phthalates (for example, dibutyl phthalate, dioctyl phthalate, dicyclohexyl phthalate, etc.), higher saturated/unsaturated fatty acid esters (for example, ethyl oleate, etc.), higher alcohols and phenols.

In the present invention, the high boiling organic solvents may be used alone or as a combination of two or more of them.

The low boiling organic solvents as used herein mean organic solvents which are useful in dispersion for emulsification, finally substantially removed from the photographic materials in the drying step in coating or by the above-mentioned methods, and low in melting point, or soluble in water to some extent and removable by washing with water.

The low boiling organic solvents include ethyl acetate, butyl acetate, ethyl propionate, secondary butyl alcohol, methyl ethyl ketone, methyl isobutyl ketone, β-ethoxyethyl acetate, methyl cellosolve acetate and cyclohexanone.

In addition, organic solvents completely miscible with water such as methyl alcohol, ethyl alcohol, acetone and tetrahydrofuran can be partially used in combination.

These organic solvents may be used alone or as a combination of two or more of them.

The average particle size of the particles contained in the emulsified products thus prepared is preferably 0.02 μm to 2 μm, and more preferably 0.04 μm to 0.4 μm. The grain size of the particles contained in the emulsified products can be measured with a measuring device, for example, a nanosizer manufactured by Coulter Co., U.S.A.

In the present invention, the above-mentioned high boiling organic solvents and polymers are preferably used within the range of 10 to 400% by weight, particularly 20 to 300% by weight based on the compounds represented by formula [I] or (A).

In the present invention, when the compounds represented by formula [I] or (A) are added to the polymer particles, it is preferred that the melting point lowering agents are allowed to exist.

The melting point lowering agents used in the present invention means organic compounds substantially insoluble in water, which are substantially anti-diffusible and have the function of lowering the melting point of the compounds represented by formula [I] or (A) when mixed with them.

The solid dispersions of finely divided (crystalline) particles of the compounds represented by formula [I] or (A) can be mechanically prepared by use of known pulverizing means (for example, a ball mill, a vibrating ball mill, a planetary ball mill, a sand mill, a colloid mill, jet mill or a roller mill) in the presence of dispersing agents using appropriate solvents (such as water and alcohols) if desired.

Further, the finely divided (crystalline) particles of the compounds can be obtained utilizing the method of dissolving the compounds in appropriate solvents by use of surfactants for dispersion, and then adding the resulting solutions to poor solvents to precipitate fine crystals, or the method of dissolving the compounds by control of the pH, followed by changing the pH to form fine crystals. The finely divided (crystalline) particles thus obtained are dispersed in appropriate binders, thereby preparing approximately homogeneous solid dispersions of particles, followed by application thereof to desired supports to provide layers containing the fine powders of the compounds. The layers can also be provided by use of the method of applying the compounds which are dissociated in the salt form, followed by overcoat of acidic gelatin to fix dispersion in coating.

There is no particular limitation on the above-mentioned binders, as long as they are hydrophilic colloids which can be used in light-sensitive emulsion layers or light-insensitive layers, but gelatin or synthetic polymers are generally used. As the surfactants for dispersion, known surfactants can be used. Artionic, nonionic and amphoteric surfactants are preferably used. In particular, use of anionic and/or nonionic surfactants are preferred.

The average particle size of the finely divided particles of the compounds contained in the solid dispersions is 0.005 μm to 10 μm, preferably 0.01 μm to 1 μm, and more preferably 0.01 μm to 0.5 μm.

The silver halide photographic material of the present invention contains a silver chloride-containing tabular grain emulsion, wherein at least 50% of the total projected area of silver halide grains accounts for silver chloride-containing tabular grains having a silver chloride content of 20% or more, and the tabular grains have an average aspect ratio of 2 or more.

The emulsions are hereinafter described in detail.

In the silver halide emulsion containing at least a dispersion medium and silver halide grains, 50% or more, preferably from 60% to 100%, and more preferably from 70% to 100% of the total projected area of the silver halide grains have a $Cl^-$ content of 20 mol % or more, preferably from 30 to 100 mol %, more preferably from 40 to 100 mol %, and most preferably from 50 to 100 mol %, and the silver halide grains are tabular grains each having a (100) face or a (111) face as a major face. Herein, the tabular grains mean grains having an aspect ratio (diameter/thickness) of 1 or more. The major face means the maximum outer surface of the tabular grain. The tabular grains have a thickness of 0.35 μm or less, preferably from 0.05 to 0.3 μm, and more preferably from 0.05 to 0.25 μm. The average aspect ratio is 2 or more, preferably from 2 to 25, and more preferably from 5 to 20. Herein, the diameter means a diameter of a circle having an area equivalent to a projected area of the tabular grain, and the thickness means a distance between the two major faces. The average aspect ratio is an average value of aspect ratios of the total tabular grains.

Of the emulsions of the present invention, the nucleation of emulsions having (111) faces as the major faces is described in detail in JP-B-64-8326, JP-B-64-8325, JP-B-

64-8324, JP-A-1-250943, JP-B-3-14328, JP-B-4-81782, JP-B-5-40298, JP-B-5-39459, JP-B-5-12696, JP-A-63-213836, JP-A-63-218938, JP-A-63-281149, JP-A-62-218959, etc., and prior-art techniques of tabular grains having (100) faces as the major faces are described in JP-A-5-204073, JP-A-51-88017, JP-A-63-24238, JP-A-7-146522, etc.

In the present invention, methods of nucleation described in these prior-art references can be arbitrarily used.

Methods for allowing crystals to grow by physical ripening (fine grains dissolve and substrate grains grow) in the presence of fine silver halide grains of the present invention are described below.

In the fine grain emulsion addition method, the growth of tabular grains are effected through the Ostwald ripening, by adding an emulsion of fine AgX grains having a diameter of 0.15 μm or less, preferably 0.1 μm or less, and more preferably from 0.06 to 0.006 μm. The fine grain emulsion can be added continuously or successively. The fine grain emulsion is continuously prepared by feeding an $AgNO_3$ solution and an $X^-$ salt solution into a mixer provided in the vicinity of a reaction vessel and immediately added continuously to the reaction vessel, or the fine grain emulsion is previously prepared in another vessel by a batch operation and thereafter can be added thereto continuously or successively. The fine grain emulsion can be added in the liquid state or as dried powder. The dried powder can also be mixed with water just before addition to liquidize, followed by addition. The addition is preferably conducted so that the fine grains added can disappear within 20 minutes, and more preferably in the range of from 10 seconds to 10 minutes. Prolonged disappearance undesirably generates ripening between the fine grains, causing the grain size to increase. Accordingly, it is preferred not to add the total amount of the fine grains at once. It is preferred that the fine grains do not substantially contain multiple twin crystalline grains. The term "multiple twin crystalline grain" means a grain having 2 or more twin planes per grain. The term "do not substantially contain" means a number ratio of multiple twin crystalline grains of 5% or less, preferably 1% or less, and more preferably 0.1% or less. Further, it is preferred that the fine grains also do not substantially contain single twin crystalline grains. Furthermore, it is preferred that the fine grains do not substantially contain screw dislocation. Here again, "do not substantially contain" follows the same rule as that mentioned above.

The halogen components of the fine grains are AgCl, AgBr, AgBrI (the $I^-$ content is preferably 10 mol % or less, and more preferably 5 mol % or less), and mixed crystals containing 2 or more kinds of them. As to other details, the description of JP-A-6-59360 can be referred.

The total amount of the fine grains to be added is required to be 20% or more, preferably 40% or more, and more preferably from 50% to 98%, based on the total amount of silver halides.

The Cl content of the fine grains is preferably 10% or more, and more preferably from 50% to 100%.

Conventional dispersion media for AgX emulsions can be used as dispersion media used in nucleating, ripening and growing, and particularly, gelatin having a methionine content of preferably 0 to 50 μmol/g, more preferably 0 to 30 μmol/g is preferably used. The use of gelatin in ripening and growing makes it possible to form thinner tabular grains having an uniform distribution in diameter size. Further, synthetic polymers described in JP-B-52-16365, *Nippon Shashin Gakkai Shi*, vol. 29 (1), pp. 17, 22 (1966), ibid., vol. 30 (1), pp. 10, 19 (1967), ibid., vol. 30 (2), p. 17 (1967), and ibid., vol. 33 (3), p. 24 (1967) can be preferably used as dispersion media. In the growing step beginning with addition of the fine grains, the pH needs to be 2.0 or more, preferably from 6 to 10, and more preferably from 6 to 9.

The pCl needs to be 1.0 or more, preferably 1.6 or more, and more preferably from 2.0 to 3.0.

These growing conditions are preferred particularly for the tabular grains having the (100) faces as the major faces.

The pCl is defined by the following equation:

$$pCl=-\log[Cl^-]$$

wherein $[Cl^-]$ is an activity of $Cl^-$ ion in a solution. This is described in detail in T. H. James, *THE THEORY OF THE PHOTOGRAPHIC PROCESS*, the fourth edition, the first chapter.

When the pH is decreased to less than 2.0, for example, in the case of the tabular grains having the (100) faces as the major faces, the growth in the horizontal direction is inhibited to lower the aspect ratio, resulting in a tendency to reduce the covering power of the emulsion and to lower the sensitivity. When the pH is 2.0 or more, the growing speed in the horizontal direction increases to heighten the aspect ratio, resulting in the increased covering power of the emulsion, but in a tendency to increase the fogging property and to lower the sensitivity.

When the pCl is less than 1.0, the growth in the vertical direction is promoted to lower the aspect ratio, resulting in the lowered covering power of the emulsion and the lowered sensitivity. When the pCl is 1.6 or more, the aspect ratio is heightened, resulting in the increased covering power, but in a tendency to increase the fogging property and to lower the sensitivity. However, it has been found that, when the substrate grains are allowed to grow by the fine silver halide grains, the low fogging property, the high sensitivity, the high aspect ratio and the higher covering power can be attained even at pH 6.0 or more and/or at pCl 1.6 or more.

With respect to the monodispersibility of the emulsions of the present invention, the degree of monodispersion is preferably 30% or less and more preferably from 5% to 25%, when considered on the base of the coefficient of variation defined by the method described in JP-A-59-745481. In particular, when the emulsions are used in hard photographic materials, it is preferably from 5% to 15%.

Selenium sensitization and tellurium sensitization preferably used in the present invention will be described below. They may be used alone or in combination. In particular, preferred examples of theses uses and compounds are described in detail in JP-A-3-116132, JP-A-5-113635, JP-A-5-165136, JP-A-5-165137, JP-A-5-134345, etc.

Particularly preferred examples of selenium sensitizers used include compounds represented by formulas (I) and (II) described in JP-A-5-165137 and example compounds I-1 to 1-20 and II-1 to II-19 described therein. Examples of tellurium sensitizers include compounds represented by formulas (IV) and (V) described in JP-A-5-134345 and example compounds IV-1 to IV-22 and V-1 to V-16 described therein.

For formation of the silver chloride-containing tabular grains used in the present invention, nucleation and growth can be preferably conducted by addition of an aqueous solution of halogen and an aqueous solution of silver nitrate to a reaction vessel just before mixing thereof by use of a device such as a multiple coaxial nozzle described in JP-A-4-139439, JP-A-4-139440, JP-A-4-139441 or U.S. Pat. No. 5,104,786.

The photographic material of the present invention fully exhibits the effect, particularly when it contains at least one silver halide emulsion layer on each the both sides of the support.

Application of the present invention to the photographic materials having the emulsion layers on the both sides of the support makes it possible to obtain images with high image quality and high sharpness, besides the above-mentioned effect, and further to have the unexpected effect that tanks and rollers are not stained, when the replenishment rate is decreased during development processing.

As chemical sensitization, it is possible to use so-called gold sensitization with gold compounds, sensitization with metals such as iridium, platinum, rhodium and palladium, sulfur sensitization using sulfur-containing compounds, reduction sensitization with stannous salts or polyamines, sensitization with selenium compounds, sensitization with tellurium compounds, or combinations of 2 or more kinds of these sensitizing methods. The tabular silver halide grains can be prepared by appropriate combinations of methods known in the art.

Then, developing solutions for the silver halide photographic materials of the present invention are described below. The compounds represented by formula [I] or (A) act as developing agents. The compounds are contained in the photographic materials, so that developing agents are substantially unnecessary to be contained in developing solutions.

As the developing solutions, solutions comprising alkali buffers and alkali agents such as metal hydroxides, carbonates, phosphates and borates are preferably used. It is desirable that the developing solutions further contain auxiliary developing agents.

As the auxiliary developing agents, 1-phenyl-3-pyrazolidone compounds and p-aminophenol compounds are preferably used.

Examples of 1-phenyl-3-pyrazolidone and derivative thereof as auxiliary developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4-methyl-4-hydroxymethyl-3-pyrazolidone and 1,5-diphenyl-3-pyrazolidone.

The p-aminophenol auxiliary developing agents include N-methyl-p-aminophenol, p-aminophenol, N-(β-hydroxyethyl)-p-aminophenol, N-(4-hydroxyphenyl) glycine, 2-methyl-p-aminophenol and p-benzylaminophenol.

When the auxiliary developing agents are contained in the photographic materials, it is preferred that they are previously converted to precursors by substitution by functional groups which leave under alkaline conditions.

When the auxiliary developing agents used in the present invention are contained in the developing solutions, they are used preferably in an amount of $10^{-3}$ to 1 mol/liter, and more preferably in an amount of $10^{-3}$ to $10^{-1}$ mol/liter.

When the auxiliary developing agents used in the present invention are contained in the photographic materials, they are used preferably in an amount of $10^{-4}$ to $10^{-1}$ mol per mol of silver halide, and more preferably in an amount of $10^{-3}$ to $10^{-2}$ mol.

The pH of the developing solutions used in the present invention is preferably 12 or less, and more preferably 9.5 to 11.0. As alkali agents used for establishment of the pH, usual water-soluble inorganic alkali metal salts (for example, sodium hydroxide and sodium carbonate) can be used.

Ascorbic acid and derivatives thereof may be used in the developing agents used in the present invention.

Sulfites may be used in the developing agents used in the present invention.

The sulfites include sodium sulfite, potassium sulfite, lithium sulfite, ammonium sulfite, sodium bisulfite, potassium metabisulfite and sodium formaldehydebisulfite. The sulfites are preferably used in an amount of 0.01 to 0.8 mol/liter.

The developing solutions used in the present invention may contain amino compounds for development acceleration. In particular, amino compounds described in JP-A-56-106244, JP-A-61-267759 and JP-A-1-29418 may be used.

The developing solutions used in the present invention may further contain pH buffers such as boric acid, borax, sodium secondary phosphate, potassium secondary phosphate, sodium primary phosphate and potassium primary phosphate; other pH buffers described in JP-A-60-93433; development inhibitors such as potassium bromide and potassium iodide; organic solvents such as dimethylformamide, methyl cellosolve, hexylene glycol, ethanol and methanol; and additives such as benzotriazole derivatives and nitroindazole derivatives. The benzotriazole derivatives include 5-methylbenzotriazole, 5-bromobenzotriazole, 5-chlorobenzotriazole, 5-butylbenzotriazole and benzotriazole, and particularly 5-methylbenzotriazole is preferred. The nitroindazole derivatives include 5-nitroindazole, 6-nitroindazole, 4-nitroindazole, 7-nitroindazole and 3-cyano-5-nitroindazole, and particularly 5-nitroindazole is preferred. In particular, when the compound such as 5-nitroindazole is used, it is generally previously dissolved in a portion other than a portion containing a dihydroxybenzene developing agent and a sulfite preservative, and both the portions are mixed, followed by addition of water thereto at the time of use. Further, if the portion in which 5-nitroindazole is dissolved is alkaline, the portion is colored yellow, resulting in convenient handling.

In addition, the developing solutions may contain color toning agents, surfactants, water softeners and hardening agents as so desired.

Examples of chelating agents contained in the developing solutions include ethylenediaminediorthohydroxyphenylacetic acid, diaminopropanetetraacetic acid, nitrilotriacetic acid, hydroxyethylethylenediaminetriacetic acid, hydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminetetraacetic acid, ethylenediaminetetraacetic acid, glycoletherdiaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarobxylic acid, catechol-3,5- disulfonic acid, sodium pyrophosphate, sodium tetrapolyphosphate and sodium hexametaphosphate. Particularly preferred examples thereof include diethylenetriaminepentaacetic acid, triethylenetetraminehexaacetic acid, 1,3-diaminopropanoltetraacetic acid, glycoletherdiaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid and salts thereof.

For the purpose of preventing silver sludge, compounds described in JP-B-62-4702, JP-B-62-4703, JP-A-1-200249, JP-A-4-362942, JP-A-5-303179 and JP-A-5-53257 can be used.

In addition, the developing solutions used in the present invention may contain dialdehyde hardening agents or bisulfite adducts thereof. Examples thereof include glutaraldehyde, α-methylglutaraldehyde, β-methylglutaraidehyde, maleic dialdehyde, succinic dialdehyde, methoxysuccinic dialdehyde, methylsuccinic dialdehyde, α-methoxy-β-ethoxyglutaraldehyde, α-n-butoxyglutaraldehyde, α,α-dimethoxysuccinic dialdehyde, β-isopropylsuccinic dialdehyde, α,α-diethylsuccinic dialdehyde, butylmaleic dialdehyde and bisulfite adducts thereof. The dialdehyde compounds are used in such an amount that the sensitivity of photographic layers processed is not inhibited and the drying time is not extremely prolonged, specifically, in an amount of 1 to 50 g, preferably 3 to 10 g per liter of developing solution. these, glutaraldehyde or bisulfite adducts thereof are most generally used.

When the bisulfite adducts of the dialdehyde hardening agents are used, bisulfites of the adducts are of course calculated as sulfites contained in the developing solutions.

Besides these, additives described in L. F. A. Maison, *Photographic Processing Chemistry*, Focal Press, pp. 226–229 (1966), U.S. Pat. Nos. 2,193,015 and 2,592,364, JP-A-48-64933, etc. may also be used.

In the present invention, ascorbic acid and its derivatives can be used in the developing solutions. For example, compounds represented by formula (I) described in JP-A-5-165161 and example compounds I-1 to I-8 and II-9 to II-12 described therein are preferred.

The ascorbic acid compounds contained in the developing solutions used in the present invention are generally known as compounds of the Endiol type, the Enaminol type, the Endiamine type, the Thiol-Enol type and the Enamine-Thiol type. Examples of these compounds are described in U.S. Pat. No. 2,688,549, JP-A-62-237443, etc. Methods for synthesizing these ascorbic acid compounds are also well known, and described in, for example, Tugio Nomura and Hirohisa Ohmura, *Chemistry of Reductone*, Uchida Rokakuho Shinsha, 1969.

The ascorbic acid compounds used in the present invention can also be used in the form of alkali metal salts such as lithium salts, sodium salts and potassium salts. These ascorbic acid compounds are preferably used in an amount of 1 to 100 g per liter of developing solution, and more preferably in an amount of 5 to 80 g per liter.

In the present invention, it is particularly preferred that 1-phenyl-3-pyrazolidones or p-aminophenols are used together with the ascorbic acid compounds.

Examples of the 3-pyrazolidone-based developing agents used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

In general, the developing agents are preferably used in an amount of 0.001 to 1.2 mol/liter.

Examples of the p-aminophenol-based developing agents used in the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol, and among them, N-methyl-p-aminophenol is preferred.

Alkali agents used for establishment of the pH include pH adjustors such as sodium hydroxide, potassium hydroxide, sodium carbonate, potassium carbonate, sodium tertiary phosphate and potassium tertiary phosphate.

Sulfites used as preservatives for the developing solutions in the present invention include sodium sulfite, potassium sulfite, lithium sulfite, ammonium sulfite, sodium bisulfite and potassium metabisulfite. The amount of sulfites to be used is 0.01 mol/liter or more, and preferably 0.02 mol or more. The upper limit is preferably 2.5 mol/liter.

Besides these, preservatives described in L. F. A. Maison, *Photographic Processing Chemistry*, Focal Press, pp. 226–229 (1966), U.S. Pat. Nos. 2,193,015 and 2,592,364, JP-A-48-64933, etc. may also be used.

In general, the developing solutions often contain boric acid compounds (for example, boric acid and borax) as pH buffers. However, it is preferred that the ascorbic acid-containing developing solutions used in the present invention does not substantially contain boric acid compounds.

When the ascorbic acid-containing developing solutions contain boric acid compounds, the effect of the present invention can not be achieved, even in combination with wrapping materials of low oxygen permeability.

In the system of the present invention, the relationship between the presence or absence of the boric acid compound and the effect was quite an unexpected matter.

The processing solutions used in the present invention can be chemically mixed according to the methods described in JP-A-61-177132, JP-A-3-134666 and JP-A-3-67258.

In the processing methods of the present invention, the developing solutions can be replenished by the method described in JP-A-5-216180.

It is more preferred that, when a dry-to-dry process is conducted within 100 seconds, a roller of rubber material as described in JP-A-63-151943 is used as an outlet roller of a developing tank to prevent uneven development inherent in rapid processing, that the extrusion flow rate for stirring the developing solution in the tank is adjusted to 10 m/minute or more as described in JP-A-63-151944, and that the developing solution is stirred more intensively at least during development processing than during standing-by as described in JP-A-63-264758.

In the methods for developing the sensitive materials of the present invention, there is no particular limitation on photographic materials, and general black and white photographic materials are mainly used. The methods can also be used particularly for photographic materials for the laser source, light-sensitive materials for printing, medical direct radiographic materials, medical indirect radiographic materials, medical photofluorographic materials, CRT image-recording light-sensitive materials, microfilms, light-sensitive materials for general photographing, etc.

Although various types of automatic processors such as roller transfer type and belt transfer type automatic processors can be used in the present invention, the roller transfer type automatic processors are preferably used. Use of automatic processors having tanks low in opening ratio as described in JP-A-1-166040 and JP-A-1-193853 reduces air oxidation and evaporation, which makes it possible to operate stably to the processing environment and further to decrease the replenishment rate of washing water.

As the method for decreasing the replenishment rate of washing water, the multistage (for example, two-stage or three-stage) countercurrent system has been known for long. When this multistage countercurrent system is applied to the present invention, the photographic materials after development are gradually processed toward a fresh direction, namely, processed in turn contacting with processing solutions not contaminated with the developing agents, resulting in more efficient washing.

In water-saving processing or non-piping processing, antifungal means are preferably applied to washing water or stabilizing solutions.

The antifungal means which can be used include an ultraviolet irradiation method described in JP-A-60-263939, a method using a magnetic field described in JP-A-60-263940, a method using an ion-exchange resin to obtain pure water described in JP-A-61-131632 and methods using microbiocides described in JP-A-61-115154, JP-A-62-153952, JP-A-62-220951 and JP-A-62-209532.

Further, microbiocides, antifungal agents, surfactants, etc. described in L. F. West, "Water Quality Criteria", *Photo. Sci. & Eng.*, vol. 9, No. 6 (1965), M. W. Beach, "Microbiological Growths in Motion-Picture Processing", *SMPTE Journal*, vol. 85 (1976), R. D. Deegan, "Photo Processing Wash Water Biocides", *J. Imaging Tech.*, vol. 10, No. 6 (1984), JP-A-57-8542, JP-A-57-58143, JP-A-58-105145, JP-A-57-132146, JP-A-58-18631, JP-A-57-97530 and JP-A-57-157244 can also be used in combination.

Furthermore, isothiazoline compounds described in R. T. Kreiman, *J. Image. Tech.*, vol. 10, No. 6, p. 242 (1984), isothiazoline compounds described in *Research Disclosure*, vol. 205, No. 20526 (May, 1981), isothiazoline compounds described in ibid., vol. 228, No. 22845 (April, 1983) and compounds described in JP-A-62-20952 can also be used in combination as microbiocides in washing baths or stabilizing baths.

In addition, compounds as described in Hiroshi Horiguchi, *Bohkin Bohbai no Kagaku* (*Chemistry of Bacteria Prevention and Fungus Prevention*), Sankyo Shuppan (1982) and *Bohkin Bohbai Gijutsu Handbook* (*Handbook of Bacteria Prevention and Fungus Prevention*), edited by Nippon Bohkin Bohbai Gakkai, Hakuhohdoh (1986) may be contained.

When washing is carried out with a small amount of water in the present invention, it is more preferred to provide washing tanks with squeegee rolls described in JP-A-63-18350. A washing step as described in JP-A-63-143548 is also preferably used.

Moreover, in the present invention, an overflowed solution from a washing or stabilizing bath produced by replenishing water subjected to antifungal treatment to the washing or stabilizing bath depending on processing can also be partly or wholly utilized as a replenisher of a fixing processing solution or a developing processing solution for diluting the preceding processing step as described in JP-A-60-235133.

In the present invention, the term "developing step time" or "developing time" means the time from immersion of a leading edge of a photographic material in a developing tank solution of an automatic processor up to immersion thereof in the subsequent washing tank solution (stabilizing tank solution), and the term "washing time" means the time for which the photographic material is immersed in the washing tank.

Further, the term "drying time" means the time for which the photographic material stays in a drying zone with which an automatic processor is usually provided, air heated to 35° C. to 100° C., preferably 40° C. to 80° C., being blown on the photographic material in the drying zone.

In the present invention, the developing time is 5 to 30 seconds and preferably 7 to 17 seconds, and the developing temperature is preferably 25° C. to 50° C. and more preferably 30° C. to 40° C.

The temperature and the time in the washing bath (or the stabilizing bath) are preferably 0° C. to 50° C. and 5 to 30 seconds, respectively, and more preferably 15° C. to 40° C. and 7 to 17 seconds.

The photographic materials which have been developed and washed (or stabilized) are squeegeed to remove washing water off, namely allowed to pass through squeegee rolls to dry them. Drying is conducted at about 40° C. to about 100° C. The drying time is usually about 5 seconds to 40 seconds, and preferably about 5 seconds to 30 seconds at 40° C. to 80° C., although appropriately changed according to the ambient conditions.

The silver halide photographic materials of the present invention have an amount of silver coated per one side of 2.0 $g/m^2$ or less, preferably 0.5 to 1.8 $g/m^2$, more preferably 0.7 to 1.5 $g/m^2$.

Further, the total coating amount of gelatin on the side of the silver halide emulsion layers in the present invention is preferably 1.0 to 5.0 $g/m^2$ for rapid processing, more preferably 1.5 to 4.5 $g/m^2$, and most preferably 2.0 to 3.0 $g/m^2$.

Furthermore, the weight ratio of silver to gelatin contained in the silver halide emulsion layers is an important factor from the viewpoint of rapid processing. If the ratio of silver to gelatin contained in the silver halide emulsion layers is heightened, the silver halide photographic materials are separated with projections of rolls when processed with an automatic processor, resulting in production of emulsion pick off which makes images indistinct. From this viewpoints, the weight ratio of silver to gelatin contained in the silver halide emulsion layers is preferably 0.1 to 1.8, more preferably 0.2 to 1.6, and most preferably 0.2 to 1.4.

Various additives described in the following corresponding portions can be used in the photographic materials of the present invention.

| Item | Corresponding Portion |
|---|---|
| 1. Chemical Sensitization | JP-A-2-68539, page 10, upper right column, line 13 to upper left column, line 16; JP-A-5-313282 |
| 2. Antifoggants and Stabilizers | JP-A-2-68539, page 10, lower left column, line 17 to page 11, upper left column, line 7; page 3, lower left column, line 2 to page 4, lower left column |
| 3. Color Tone Improver | JP-A-62-276539, page 2, lower left column, line 7 to page 10, lower left column, line 20; JP-A-3-94249, page 6, lower left column, line 15 to page 11, upper right column, line 19 |
| 4. Surfactants and Antistatic Agents | JP-A-2-68539, page 11, upper left column, line 14 to page 12, upper left column, line 9 |
| 5. Matting Agents, Lubricants and Plasticizers | JP-A-2-68539, page 12, upper left column, line 10 to upper right column, line 10, page 14, lower left column, line 10 to lower right column, line 1 |
| 6. Hydrophilic Colloids | JP-A-2-68539, page 12, upper right column, line 11 to lower left column, line 16 |
| 7. Hardeners | JP-A-2-68539, page 12, lower left column, line 17 to page 13, upper right column, line 6 |
| 8. Polyhydroxybenzenes | JP-A-3-39948, page 11, upper left column to page 12, lower left column; European Patent 452772A |
| 9. Supports | JP-A-2-68539, page 13, upper right column, line 17 to line 20 |

-continued

| Item | Corresponding Portion |
|---|---|
| 10. Package Form | JP-A-63-223747; U.S. Pat. No. 4,915,229 |

Preferred examples of methods for forming images using the photographic materials of the present invention include a method for forming images in combination with a phosphor having a main peak preferably at 400 nm or less, and more preferably a method for forming images in combination with a phosphor having a main peak at 380 nm or less.

As screens each having a main peak of emission at 400 nm or less, screens described in JP-A-6-11804 and W093/01521 can be used, but the present invention is not limited thereto.

In the present invention, the emission wavelength of the phosphors is preferably 400 nm or less, and more preferably 370 nm or less.

Typical examples of the phosphors include M' phase $YTaO_4$ alone or compounds thereof containing Gd, Bi, Pb, Ce, Sr, Al, Rb, Ca, Cr, Cd, Nb, etc., compounds in which Gd, Tm, Gd and Tm, Gd and Ce, or Tb is added to LaOBr, the oxide of HfZr alone or compounds thereof containing Ge, Ti alkali metals, etc., $Y_2O_3$ alone or compounds thereof containing Gd and Eu, compounds in which Gd is added to $Y_2O_2S$, and compounds in which Gd, Tl and Ce are used in mother bodies of various phosphors as activating agents. In particular, M' phase $YTaO_4$ alone or compounds thereof containing Gd and Sr, compounds in which Gd, Tm, or Gd and Tm is added to LaOBr, and the oxide of HfZr alone or compounds thereof containing Ge, Ti alkali metals, etc. are preferred.

The grain size of the phosphors is preferably 1 to 20 μm, but can be changed depending on desired sensitivity and manufacturing problems. The amount of the phosphors coated is preferably 400 to 2,000 g/mm$^2$, but it can not be absolutely decided depending on desired sensitivity and image quality. For a intensifying screen, a grain size distribution may be given from the vicinity of a support to a surface. In this case, larger grains are known to be generally disposed in the vicinity of the surface. The space filling factor of the phosphors is 40% or more, and more preferably 60% or more.

When phosphor layers are arranged on both sides of the photographic material, the amount of the phosphor coated on an X-ray incident side may be different from that on the opposite side thereof. In general, a smaller amount of the phosphor is known to be coated in the intensifying screen on the X-ray incident side for shielding by means of the intensifying screen on the X-ray incident side, particularly when a high-sensitive system is required.

Supports used in the present invention are formed of paper, metal plates or polymer sheets. However, flexible sheets of polyethylene terephthalate, etc. are generally used. Reflecting agents or light absorbers may be added to the supports, or may be provided on surfaces thereof as additional layers.

Fine unevenness may be formed on the surfaces of the supports, or adhesive layers for enhancing adhesion with phosphor layers or conductive layers may be provided thereon as undercoat layers. The reflecting agents include zinc oxide, titanium oxide and barium sulfate. Titanium oxide and barium sulfate are preferably used because the wavelength of the phosphors is short. The reflecting agent may be allowed to exist not only in the support or between the support and the phosphor layer, but also in the phosphor layer. When the reflecting agent is allowed to exist in the phosphor layer, it is preferred that the reflecting agent is localized in the vicinity of the support.

Binders used in the present invention include natural polymers such as proteins such as gelatin, polysaccharides such as dextran and cornstarch, and gum arabic; and synthetic polymers such as polyvinyl butyral, polyvinyl acetate, polyurethanes, polyalkyl acrylates, vinylidene chloride, nitrocellulose, fluorine-containing polymers and polyesters, mixtures thereof or copolymers thereof. Binders having a high transmittance to emission from the phosphors as the basic property are preferred. In this point, preferred examples of such binders include gelatin, cornstarch, acrylic polymers, fluorine-containing olefin polymers, fluorine-containing olefin copolymers and styrene/acrylonitrile copolymers. These binders may have functional groups through which the binders are crosslinked by use of crosslinking agents. Depending on desired image quality, absorbers to emission from the phosphors may be added to the binders, or binders low in transmittance may be used. The absorbers include pigments, dyes and ultraviolet absorbing compounds. The volume ratio of the phosphors to the binders is 1:5 to 50:1, and preferably 1:1 to 15:1. The ratio of the phosphors to the binders may be uniform or non-uniform in the thickness direction.

The phosphor layers are usually formed by coating methods using coating solutions in which phosphors are dispersed in binder solutions. Solvents for the coating solutions include water, organic solvents such as alcohols, chlorine-containing hydrocarbons, ketones, esters, aromatic ether compounds, and mixtures thereof.

The coating solutions may contain dispersion stabilizers for phosphor grains such as phthalic acid, stearic acid, caproic acid and surfactants, or plasticizers such as phosphates, phthalates, glycolates, polyesters and polyethylene glycol.

In the present invention, protective layers can be provided on the phosphor layers. The protective layers are generally formed by applying protective coating solutions onto the phosphor layers or laminating the phosphor layers with protective layer films separately prepared. In the coating methods, the protective coating solutions may be applied at the same time that the phosphor coating solutions are applied, or may be applied after the phosphor coating solutions have been applied and dried. The protective layers may be formed of the same materials as the binders of the phosphor layers or different materials. The materials used as the protective layers include cellulose derivatives, polyvinyl chloride, melamine resins, phenol resins and epoxy resins, as well as the binders of the phosphor layers. Preferred examples include gelatin, cornstarch, acrylic polymers, fluorine-containing olefin polymer, fluorine-containing olefin copolymer and styrene/acrylonitrile copolymers. The thickness of the protective layers is generally 1 to 20 μm, preferably 2 to 10 μm, and more preferably 2 to 6 μm. It is preferred that surfaces of the protective layers are embossed. Further, matte agents or materials having light scattering property to emission depending on desired images, for example, titanium oxide, may be allowed to exist in the protective layers.

Surface slipperiness may be given to the protective layers. Preferred examples of lubricants include polysiloxane skeleton-containing oligomers and perfluoroalkyl group-containing oligomers.

Further, conductivity may be given to the protective layers. Conductivity imparting agents include white or transparent inorganic conductive materials and organic antistatic agents. Preferred examples of the inorganic conductive materials include ZnO powder, whisker, $SnO_2$ and ITO.

Furthermore, the photographic materials of the present invention can form good photographic images in combination with X-ray absorbent fluorescent intensifying screens having the maximum peak between 540 nm and 555 nm. Examples of these phosphors include $Gd_2O_2S$:Tb and $La_2O_2S$:Tb.

When the screens are formed using these phosphors, the contents of the above-mentioned descriptions of UV screens are preferably used.

The present invention will be further described in greater detail with reference to the following examples, which are, however, not to be construed as limiting the invention.

EXAMPLE 1

Preparation of (100) Tabular Emulsion A

In a reaction vessel were placed 1,582 ml of an aqueous solution of gelatin [pH 4.3, containing 19.5 g of gelatin-1 (deionized alkali-treated bone gelatin having a methionine content of about 40 μmol/g) and 7.8 ml of a 1N solution of $HNO_3$] and 13 ml of an NaCl-1 solution (containing 10 g of NaCl per 100 ml), and while maintaining the temperature at 40 ° C., 15.6 ml portions of an Ag-1 solution (containing 20 g of $AgNO_3$ per 100 ml) and an X-1 solution (containing 7.05 g of NaCl per 100 ml) were simultaneously added thereto at a rate of 62.4 ml/minute and mixed. After stirring for 3 minutes, 28.2 ml portions of an Ag-2 solution (containing 2 g of $AgNO_3$ per 100 ml) and an X-2 solution (containing 1.4 g of KBr per 100 ml) were simultaneously mixed at a rate of 80.6 ml/minute. After stirring for 3 minutes, 46.8 ml portions of the Ag-1 solution and the X-1 solution were simultaneously added thereto at a rate of 62.4 ml/minute and mixed. After stirring for 2 minutes, 203 ml of an aqueous solution of gelatin (containing 13 g of gelatin-1, 1.3 g of NaCl, and a 1N solution of NaOH for adjusting the pH to 6.0) was added thereto to adjust the pCl to 1.8. Then, the temperature was elevated to 75° C. and ripening was conducted for 42 minutes. A fine AgCl grain emulsion (average grain diameter: 0.1 μm) was added at an addition rate of AgCl of $2.68\times10^{-2}$ mol/min over a 20-minute period. After the mixture was subjected to ripening for 10 minutes after addition, a precipitant was added thereto, and the mixture was cooled to 35° C. to develop precipitates, followed by washing with water. An aqueous solution of gelatin was added to adjust the pH to 6.0 at 60° C. Replicas of the grains were observed under a transmission electron microscope (hereinafter abbreviated as "TEM"). The resultant emulsion comprised (100) tabular grains having a high content of silver chloride which contain 0.44 mol % of AgBr based on silver. The shape characteristics of the grains are as follows:

(The total projected area of tabular grains having an aspect ratio of 1 or more/the sum of projected area of the total AgX grains)×100=$a_1$=90%

[The average aspect ratio of tabular grains (average diameter/average thickness)]=$a_2$=9.3

(The average diameter of tabular grains)=$a_3$=1.67 μm (The average thickness)=$a_4$=0.18 μm Preparation of (111) Tabular Emulsion B Tabular silver chloride grains are prepared in the following manner:

| | |
|---|---|
| Solution (1) Inert Gelatin | 30 g |
| Crystal Habit Inhibitor A | 0.8 g |

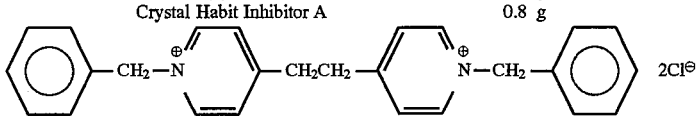

| | |
|---|---|
| NaCl | 4 g |
| $H_2O$ | 1750 cc |
| Solution (2) $AgNO_3$ | 7.6 g |
| Water to make | 30 cc |
| Solution (3) NaCl | 2.8 g |
| Water to make | 30 cc |
| Solution (4) $AgNO_3$ | 24.5 g |
| Water to make | 96 cc |
| Solution (5) NaCl | 0.3 g |
| Water to make | 65 cc |
| Solution (6) $AgNO_3$ | 101.9 g |
| Water to make | 400 cc |
| Solution (7) NaCl | 37.6 g |
| Water to make | 400 cc |

Solution (2) and solution (3) were simultaneously added with stirring to solution (1) kept at 35° C. for 1 minute, and the temperature of the resulting solution was elevated to 50° C. for 15 minutes. At this time, grains corresponding to about 5.7% of the total amount of silver were formed. Then, solution (4) and solution (5) were simultaneously added for 24 minutes, and solution (6) and solution (7) were further simultaneously added for 40 minutes to obtain a tabular silver chloride emulsion.

The emulsion was washed with water and desalted by the precipitation method, followed by addition of 30 g of gelatin and $H_2O$. Then, 2.0 g of phenoxyethanol and 0.8 g of sodium polystyrenesulfonate as a thickener were further added, followed by redispersion so as to give pH 6.0 adjusting with sodium hydroxide.

The emulsion thus obtained was an emulsion of tabular silver chloride grains having the (111) faces as the major faces, wherein $a_1$=90%, $a_3$=1.55 μm, $a_4$=0.18 μm, $a_2$=8.6, and the coefficient of variation of diameters of circles having areas equivalent to projected areas was 19%.

Preparation of Tabular Grains C

To 1 liter of water, 6.0 g of potassium bromide and 7.0 g of low molecular weight gelatin having an average molecular weight of 15,000 were added. Then, 37 cc (4.00 g of silver nitrate) of an aqueous solution of silver nitrate and 38 cc of an aqueous solution containing 5.9 g of potassium bromide were added with stirring to a vessel kept at 55° C. by the double jet method for 37 seconds. After addition of 18.6 g of gelatin, the temperature was elevated to 70° C., and 89 cc (9.80 g of silver nitrate) of an aqueous solution of silver nitrate was added for 22 minutes. At this time, 7 cc of 25% aqueous ammonia was added, and the mixture was subjected to physical ripening at the same temperature for 10 minutes, followed by addition of 6.5 cc of a 100% aqueous solution of acetic acid. Subsequently, an aqueous solution of silver nitrate (153 g) and an aqueous solution of potassium bromide were added by the double jet method for 35 minutes while being kept at pAg 8.5. Then, 15 cc of a 2N solution of potassium thiocyanate was added. The mixture was subjected to physical ripening at the same temperature for 5 minutes, followed by lowering of the temperature to 35° C. Thus, monodisperse tabular pure silver bromide grains were obtained, wherein $a_1$=95%, $a_3$=1.50 μm, $a_4$=0.185 μm, $a_2$=8.1, and the coefficient of variation of diameters of circles having areas equivalent to projected areas was 18.5%.

Then, soluble salts were removed by the precipitation method. The temperature of the grains were elevated to 40° C. again, and 2.35 g of phenoxyethanol and 0.8 g of sodium polystyrenesulfonate as a thickener were added. The resulting mixture was adjusted to pH 5.90 and pAg 8.00 with sodium hydroxide and a solution of silver nitrate.

Preparation of Tabular Grains D and E

When the aqueous solution of silver nitrate and the aqueous solution of potassium bromide were added by the double jet method while being kept at pAg 8.5 in the preparation of tabular grains C, a mixed solution of potassium bromide and potassium chloride was used in place of the aqueous solution of potassium bromide so as to give grain forms such as the aspect ratio and the grain size approximately similar to those of tabular grains C, thereby preparing tabular silver chlorobromide grains D or E having the (111) faces as the major faces and a silver chloride content of 17% or 24%. The other conditions were the same as with the preparation of tabular grains C.

Preparation of Silver Halide Emulsion F

In 1 liter of water, 32 g of gelatin was dissolved, and 0.3 g of potassium bromide, 5 g of sodium chloride and 46 mg of compound [I]

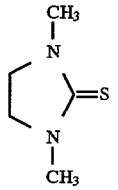

were placed in a vessel heated to 53° C. Then, 444 ml of an aqueous solution containing 80 g of silver nitrate and 452 of aqueous solution containing 5.5 g of sodium chloride were added by the double jet method for about 20 minutes. Subsequently, 400 ml of an aqueous solution containing 80 g of silver nitrate and 415 ml of an aqueous solution containing 46.4 g of potassium bromide, 5.7 g of sodium chloride and $10^{-7}$ mol/mol of silver of potassium hexachloroiridate (III) were added by the double jet method for about 25 minutes to prepare monodisperse cubic silver chlorobromide grains having a mean grain size (a diameter of a circle having an area equivalent to a projected area) of 0.34 μm and a coefficient of variation of diameters of circles having areas equivalent to projected areas of 10%.

This emulsion was desalted by the coagulation method, followed by addition of 62 g of gelatin and 1.75 g of phenoxyethanol, and the mixture was adjusted to pH 6.5 and pAg 8.5.

Chemical Sensitization

Grains A to F thus prepared were subjected to chemical sensitization with stirring and maintaining at 60° C. First, thiosulfonic acid compound-1 was added in an amount of $10^{-4}$ mol of per mol of silver halide, then, fine AgBr grains having a diameter of 0.10 μm was added in an amount of 1.0 mol % based on the total amount of silver, and thiourea dioxide was further added in an amount of $1\times10^{-6}$ mol per mol of Ag. The mixture was allowed to stand as such for 22 minutes, and subjected to reduction sensitization. Then, $3\times10^{-4}$ mol per mol of Ag of 4-hydroxy-6-methyl-1,3,3a,7-tetraazaindene, sensitizing dye-1 and sensitizing dye-2 were each added. Calcium chloride was further added. Subsequently, sodium thiosulfate ($6\times10^{-6}$ mol per mol of Ag) and selenium compound-I ($4\times10^{-6}$ mol per mol of Ag) were added. Furthermore, $1\times10^{-5}$ mol per mol of Ag of chloroauric acid and $3.0\times10^{-3}$ mol per mol of Ag of potassium thiocyanate were added, and after the elapse of 40 minutes, the mixture was cooled to 35 ° C.

Thus, the preparation of the emulsions (chemical ripening) was terminated.

Thiosulfonic Acid Compound-1

$C_2H_5SO_2SNa$

Sensitizing Dye-1

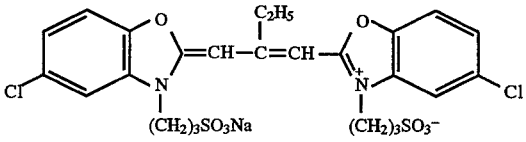

$1\times10^{-3}$ mol/mol of Ag

Sensitizing Dye-2

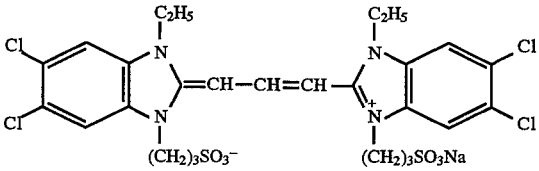

$1\times10^{-5}$ mol/mol of Ag

Selenium Compound-I

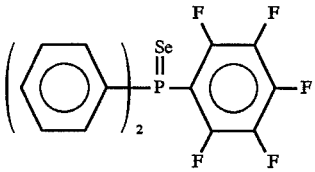

Preparation of Emulsion Coating Layers

The following chemicals per mol of silver halide were added to the emulsions subjected to chemical sensitization to make emulsion coating solutions.

| | |
|---|---|
| Gelatin (containing also gelatin in the emulsion) | 111 g |
| Dextran (average molecular weight: 39,000) | 21.5 g |
| Polysodium Acrylate (average molecular weight: 400,000) | 5.1 g |
| Polysodium Styrenesulfonate (average molecular | |

-continued

| | |
|---|---|
| weight: 600,000) | 1.2 g |
| Hardener 1,2-bis(vinylsulfonylacetamide)ethane The amount to be added was adjusted so that the degree of swelling reached 230%. | |
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |

Compound-I

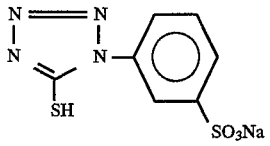

Compound-II

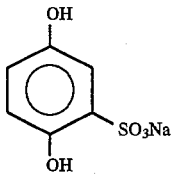

Compound-III

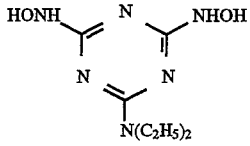

Compound-IV

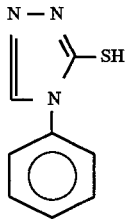

Compound-V

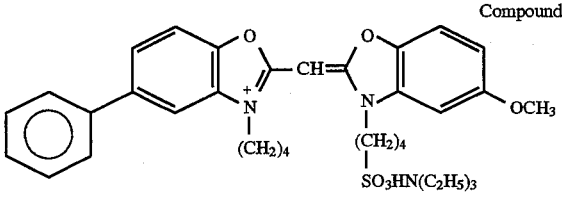

Compound-VI

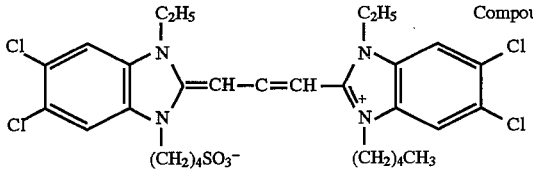

Compound-VII

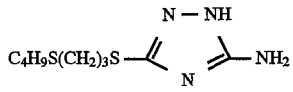

Compound-VIII

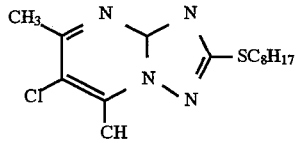

Developing Agent Dispersions D-1 to D-5 Described Below

The amounts described in Table 2 as the amounts of developing agents KI $1\times10^{-2}$ mol.

Preparation of Developing Agent Dispersions D-1 to D-5

The compound (3.1 g) described in Table 1 was dissolved in 4.8 g of tricresyl phosphate, 2 g of dibutyl phthalate and 20 cc of ethyl acetate, and mixed with 85 g of an aqueous solution of gelatin at 65° C. The resulting mixture was stirred at high speed with a homogenizer. After termination of stirring at high speed, the mixture was treated under reduced pressure by use of an evaporator to remove 90% by weight of ethyl acetate, thereby obtaining each of developing agent dispersions D-1 to D-5 having a mean grain size of 0.2 μm.

TABLE 1

| Developing Agent Dispersion | Developing Agent Compound |
|---|---|
| D-1 | I-25 |
| D-2 | I-11 |
| D-3 | I-29 |
| D-4 | I-30 |
| D-5 | A-7 |

Dye emulsion A was added to the above-mentioned coating solutions so that each of Dyes-I to III was applied in an amount of 10 mg/m$^2$ per one side, thereby preparing coating solutions. The resulting coating solutions were adjusted to pH 6.1.

Dye-I

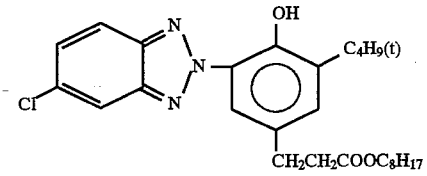

Dye-II

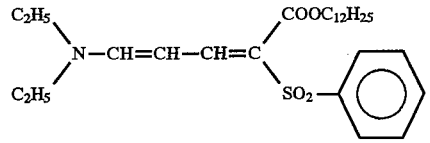

Dye-III

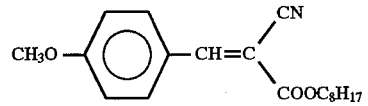

Preparation of Dye Emulsion A

Twenty grams of each of Dyes-I to III described above was dissolved in 62.8 g of High-Boiling Organic Solvent-I shown below, 62.8 g of High-Boiling Organic Solvent-II shown below and 333 g of ethyl acetate at 60 ° C. Then, 65 cc of a 5% aqueous solution of sodium dodecylsulfonate, 94 g of gelatin and 581 cc of water were added thereto, and the mixture was emulsified at 60 ° C. for 30 minutes using a dissolver. Thereafter, 2 g of Compound-IV shown below and 6 liters of water were added, and the mixture was cooled to 40° C. The mixture was concentrated using an Ultrafiltration Labomodule ACP1050 manufactured by Asahi Chemical Industry until the total amount reached 2 kg, and 1 g of Compound-IV described above was added to make dye emulsion A.

High Boiling Organic Solvent-I

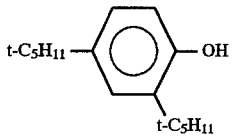

High Boiling Organic Solvent-II

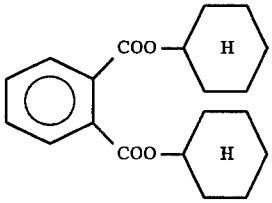

Compound-IV

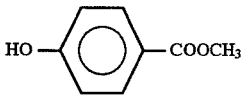

Preparation of Coating Solution for Surface Protecting Layer

A coating solution for a surface protecting layer was prepared so as to give the following amounts of respective components coated.

| | |
|---|---|
| Gelatin | 0.780 g/m$^2$ |
| Polysodium Acrylate (average molecular weight: 400,000) | 0.035 |
| Polysodium Styrenesulfonate (average molecular weight: 600,000) | 0.0012 |
| Polymethyl Methacrylate (average particle size: 4.02 μm, 99% of the total particles were between 3.66 μm and 4.38 μm) | 0.072 |
| Coating Aid-I | 0.020 |
| Coating Aid-II | 0.037 |
| Coating Aid-III | 0.0080 |
| Coating Aid-IV | 0.0032 |
| Coating Aid-V | 0.0025 |
| Compound-VII | 0.0022 |
| Proxel | 0.0010 |
| (The mixture was adjusted to pH 6.8 with NaOH.) | |

Coating Aid-I

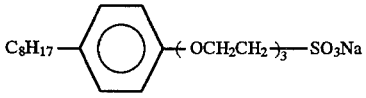

Coating Aid-II $C_{18}H_{33}O(CH_2CH_2O)_{10}H$

Coating Aid-III $C_{17}H_{33}CON(CH_3)CH_2CH_2SO_3Na$

-continued

Coating Aid-IV $C_8F_{17}SO_2N(C_3H_7)(CH_2CH_2O)_{15}H$

Coating Aid-V $C_8F_{17}SO_2N(C_3H_7)(CH_2CH_2O)_4(CH_2)_4SO_3Na$

Coating Aid-VII

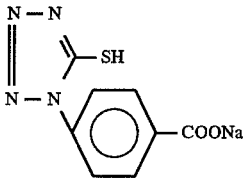

Preparation of Support A

A biaxially oriented polyethylene terephthalate film having a thickness of 175 μm was subjected to corona discharge, and coated with a first undercoat solution having the following composition with a wire converter so as to give an amount coated of 4.9 cc/m$^2$, followed by drying at 185° C. for 1 minute.

Then, a first undercoat layer was similarly formed also on the opposite surface. Polyethylene terephthalate used contained 0.06% by weight of dye-IV and 0.06% by weight of dye-V.

Dye-IV

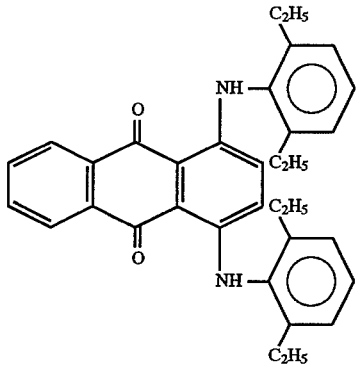

Dye-V

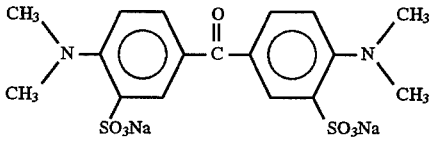

| | |
|---|---|
| Butadiene-Styrene Copolymer Latex Solution (solid content: 40%, weight ratio of butadiene/styrene = 31/69) | 158 cc |
| 4% Solution of Sodium Salt of 2, 4-Dichloro-6-hydroxy-s-triazine | 41 cc |
| Distilled Water | 801 cc |

*The latex solution contained 0.4% by weight of the following compound as an emulsifying dispersing agent, based on the latex solid content:

Emulsifying Dispersing Agent Containing

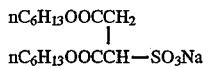

in an amount of 0.4% by weight based on the solid content of latex

The latex solution further contained the following compounds:

Coating Aid-VI

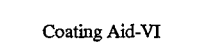

Compound-VIII

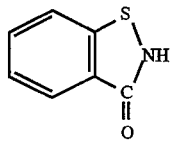

0.27 mg/m²

Preparation of Photographic Materials

The support prepared as described above was coated on the both surfaces with a combination of the above-mentioned emulsion layer and surface protective layer by the co-extrusion technique. The weight of silver coated per one surface was 1.75 g/m². Thus, the samples shown in Table 2 were prepared.

TABLE 2

| Photographic Material | Emulsion | Developing Agent Dispersion | Amount of Agent Coated mol/mol Ag |
|---|---|---|---|
| 1 (Comparison) | A | — | — |
| 2 (Invention) | A | D-1 | 0.25 |
| 3 (Invention) | A | D-1 | 0.5 |
| 4 (Comparison) | B | — | — |
| 5 (Invention) | B | D-1 | 0.5 |
| 6 (Comparison) | C | — | — |
| 7 (Comparison) | C | D-1 | 0.5 |
| 8 (Comparison) | D | D-1 | 0.5 |
| 9 (Invention) | E | D-1 | 0.5 |
| 10 (Comparison) | F | — | — |
| 11 (Comparison) | F | D-1 | 0.5 |
| 12 (Invention) | A | D-2 | 0.5 |
| 13 (Invention) | A | D-3 | 0.5 |
| 14 (Invention) | A | D-4 | 0.5 |
| 15 (Invention) | A | D-5 | 0.5 |
| 16 (Invention) | E | D-2 | 0.5 |
| 17 (Invention) | E | D-3 | 0.5 |
| 18 (Invention) | E | D-4 | 0.5 |
| 19 (Invention) | E | D-5 | 0.5 |
| 20 (Comparison) | E | — | 0.5 |

Evaluation of Photographic Materials

The photographic materials were allowed to stand at a temperature of 25° C. and a relative humidity of 50% for 7 days, and thereafter subjected to desired tests.

The photographic material was brought into close contact with An Ultra Vision Fast Detail (UV) manufactured by E. I. du Pont de Nemours and Company on both sides thereof, and exposed for a period of 0.05 second from the both sides to conduct sensitometery.

The exposure was adjusted by changing the distance between an X-ray tube and a cassette. After exposure, the photographic material was processed with an automatic processor by use of the following developing solution and fixing solution.

Development Processing

Automatic processor: Processing was conducted using the following developing solution 1 in a developing tank of CEPROS-M manufactured by Fuji Photo and Film Co., Ltd. and the following fixing solution in a fixing tank thereof.

| <Developing Solution 1> | |
|---|---|
| Potassium Hydroxide | 18 g |
| Sodium Sulfite | 35 g |
| Diethylenetriaminepentaacetic Acid | 1 g |
| Boric Acid | 9 g |
| 5-Methylbenzotriazole | 0.05 g |
| Potassium Bromide | 0.25 g |
| 1-Phenyl-4-methyl-4-hydroxymethyl-3-pyrazolidone | 1.3 g |
| Water to make | 1 liter |
| The pH was adjusted to 4.68 with sodium hydroxide. | |
| <Fixing Solution> | |
| Ammonium Thiosulfate (70 wt/wt %) | 3,000 ml |
| Disodium Ethylenediaminetetraacetate Dihydrate | 0.45 g |
| Sodium Sulfite | 225 g |
| Boric Acid | 60 g |
| 1-(N,N-Diethylamino)ethyl-5-mercapto-tetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Water to make | 6,000 ml |
| pH | 4.68 |

A washing tank was filled with service water.

Three polyethylene bottles were prepared each of which was filled with 0.4 g of perlite having an average particle size of 100 μm and an average pore size of 3 μm carrying Actinomyces as a scale inhibitor. An opening of each bottle was covered with a 300-mesh nylon cloth through which water and bacteria can pass. Two of them were sunk to the bottom of the washing tank, and one of them was sunk to the bottom of a stock tank (capacity: 0.2 liter) for washing water.

| Processing Speed and Processing Temperature: | | |
|---|---|---|
| Development | 35° C. | 8.8 seconds |
| Fixing | 32° C. | 7.7 seconds |
| Washing | 17° C. | 3.8 seconds |
| Squeegee | | 4.4 seconds |
| Drying | 58° C. | 5.3 seconds |
| Total | | 30 seconds |

| Replenishment Rate | |
|---|---|
| Developing Solution | 25 ml/10 × 12 inches |
| Fixing Solution | 25 ml/10 × 12 inches |

As shown in Table 3, the photographic materials of the present invention showed good results in evaluation of sensitometery.

TABLE 3

| Photographic Material | Sensitivity | Fog | Maximum Density |
|---|---|---|---|
| 1 | 70 | 0.18 | 3.0 |
| 2 | 250 | 0.19 | 3.5 |
| 3 | 300 | 0.20 | 3.8 |
| 4 | 105 | 0.19 | 3.1 |
| 5 | 270 | 0.21 | 3.6 |

TABLE 3-continued

| Photographic Material | Sensitivity | Fog | Maximum Density |
|---|---|---|---|
| 6 | 140 | 0.18 | 3.2 |
| 7 | 150 | 0.20 | 3.2 |
| 8 | 140 | 0.21 | 3.1 |
| 9 | 250 | 0.20 | 3.6 |
| 10 | 120 | 0.22 | 3.1 |
| 11 | 140 | 0.23 | 3.2 |
| 12 | 280 | 0.18 | 3.4 |
| 13 | 290 | 0.19 | 3.5 |
| 14 | 260 | 0.20 | 3.7 |
| 15 | 270 | 0.19 | 3.6 |
| 16 | 230 | 0.20 | 3.5 |
| 17 | 240 | 0.19 | 3.4 |
| 18 | 250 | 0.20 | 3.4 |
| 19 | 240 | 0.19 | 3.4 |
| 20 | 100 | 0.18 | 3.0 |

The sensitivity was represented by a relative value to the sensitivity of photographic material 20 which was taken as 100, using the reciprocal of a quantity of light required to give a density of 0.20.

EXAMPLE 2

The following photographic performance was evaluated using the photographic materials prepared in Example 1.

Evaluation of Photographic Performance

The photographic material was exposed for a period of 0.05 second from both sides thereof using a Fuji GRENEX Ortho Screen: HR-4 manufactured by Fuji Photo and Film Co., Ltd. After exposure, the sensitivity was evaluated using the following processing solution. The sensitivity was shown as the logarithm of the reciprocal of an exposure required to give the density of fog +0.1, and represented by a relative value to the sensitivity of emulsion C which was taken as 100. The same automatic processor as used in Example 1 was used. This X-ray screen has a phosphor composed of $Gd_2O_2S$:Tb, and has the maximum peak wavelength of emission in the vicinity of 546 nm.

| <Developing Solution 2> | |
|---|---|
| Potassium Hydroxide | 18 g |
| Sodium Sulfite | 35 g |
| Diethylenetriaminepentaacetic Acid | 1 g |
| Boric Acid | 9 g |
| Hydroquinone | 24 g |
| 5-Methylbenzotriazole | 0.05 g |
| 1-Phenyl-4-methyl-4-hydroxymethyl-3-pyrazolidone | 1.3 g |
| Potassium Bromide | 0.25 g |
| Diethylene Glycol | 10 g |
| 5-Nitroindazole | 0.13 g |
| Triethylene Glycol | 7 g |
| Glutaraldehyde (50%) | 6.5 g |
| Water to make | 1 liter |

The pH was adjusted to 10.20 with sodium hydroxide.

Photographic materials 2, 3, 5, 9 and 12 to 19 of the present invention have the photographic sensitivity even when processed with developing solution 2 reduced in pollution which contains no developing agent, which shows that this invention is effective.

EXAMPLE 3

The photographic materials prepared in Example 1 were processed with the following developing solution Processing with Automatic Processor A Fuji X-ray Processor CEPROS-S manufactured by Fuji Photo and Film Co., Ltd. was used as the automatic processor. The blow-off temperature of drying air was set to 55° C.

Formulation of Developing Solution

| | |
|---|---|
| Part A | |
| Potassium Hydroxide | 18.0 g |
| Potassium Sulfite | 30.0 g |
| Sodium Carbonate | 30.0 g |
| Diethylene Glycol | 10.0 g |
| Diethylenetriaminepentaacetic Acid | 2.0 g |
| 1-(N,N-Diethylamino)ethyl-5-mercaptotetrazole | 0.1 g |
| L-Ascorbic Acid | 43.2 g |
| 4-Hydroxymethyl-4-methyl-1-phenyl-3-pyrazolidone | 2.0 g |
| Water to make | 300 ml |
| Part B | |
| Triethylene Glycol | 45.0 g |
| 3,3'-Dithiobishydrocinnamic acid | 0.2 g |
| Glacial Acetic Acid | 5.0 g |
| 5-Nitroindazole | 0.3 g |
| 1-Phenyl-3-pyrazolidone | 3.5 g |
| Water to make | 60 ml |
| Part C | |
| Glutaraldehyde (50%) | 10.0 g |
| Potassium Bromide | 4.0 g |
| Potassium Metabisulfite | 10.0 g |
| Water to make | 50 ml |

A mixture of 300 ml of Part A, 60 ml of Part B and 50 ml of Part C was made up to 1 liter with water, and adjusted to pH 10.90.

A CE-DF1 bottle manufactured by Fuji Photo and Film Co., Ltd. was filled with 4.50 liters of Part A, 0.90 liter of Part B and 0.75 liter of Part C and used for a 1.5-liter working solution.

Development Starting Solution

A solution obtained by adding acetic acid to the above-mentioned developing replenisher to adjust the pH to 9.5 was used as a development starting solution.

As a fixing solution was used CE-F1 manufactured by Fuji Photo and Film Co., Ltd.

| | |
|---|---|
| Developing Temperature | 35° C. |
| Fixing Temperature | 35° C. |
| Drying Temperature | 55° C. |

For each photographic material, 600 film sheets having a size of 10×12 inches were subjected to running processing at a replenishment rate of 25 ml/10×21 inches (325 ml/$m^2$) (both the developing solution and the fixing solution). As a result, satisfactory results were obtained.

Photographic materials 2, 3, 5, 9 and 12 to 19 of the present invention satisfactorily showed no changes in sensitivity of the running solution from the beginning.

What is claimed is:

1. A silver halide photographic material comprising a transparent support and at least one silver halide emulsion layer provided on at least one side of said transparent support, said at least one silver halide emulsion layer comprising silver halide grains, wherein at least 50% of the total projected area of said silver halide grains accounts for silver chloride-containing tabular grains having a silver chloride content of 20 mol % or more, the silver chloride-containing tabular grains having (100) faces as major faces, and the tabular grains have an average aspect ratio of 2 or more, and the silver halide photographic material contains at least one compound represented by formula [I] or (A):

[I]

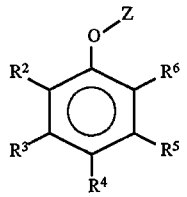

wherein $R^2$, $R^3$, $R^4$, $R^5$ and $R^6$ are the same or different and each represents a hydrogen atom or a group which can be substituted to the benzene ring, with the proviso that the total carbon atom number of $R^2$, $R^3$, $R^4$, $R^5$ and $R^6$ is 8 or more and at least one of $R^2$ and $R^4$ is a hydroxyl group, a sulfonamido group or a carbonamido group; Z represents a hydrogen atom or a protecting group which can be deprotected under alkaline conditions; and $R^2$, $R^3$, $R^4$, $R^5$ and $R^6$ and OZ may combine with each other to form a ring:

(A)

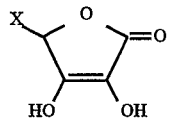

wherein X represents an aryl group, a heterocyclic group or a group represented by formula (B)

(B)

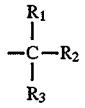

wherein $R_1$, $R_2$ and $R_3$ are the same or different, and each represents a hydrogen atom or a group other than a hydroxyl group.

2. The silver halide photographic material as claimed in claim 1, wherein $R^2$, $R^3$, $R^4$, $R^5$ and $R^6$ each represents a halogen atom, a hydroxyl group, a sulfo group, a carboxyl group, a cyano group, an alkyl group, an alkenyl group, an alkynyl group, an aralkyl group, an aryl group, a heterocyclic group, an alkoxy group, an aryloxy group, an alkylthio group, an arylthio group, a carbonamido group, a sulfonamido group, a ureido group, an alkoxycarbonylamino group, an aryloxycarbonylamino group, an acyloxy group, a sulfamoylamino group, a sulfonyloxy group, a carbamoyl group, a sulfamoyl group, an acyl group, a sulfonyl group, an alkoxycarbonyl group or an aryloxycarbonyl group.

3. The silver halide photographic material as claimed in claim 1, wherein Z represents a hydrogen atom, an acyl group, an oxycarbonyl group or a carbamoyl group.

4. The silver halide photographic material as claimed in claim 1, wherein the compound represented by formula [I] is represented by formula [II], [III], [IV] or [V]:

[II]

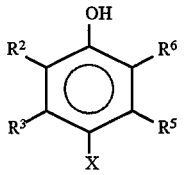

wherein X represents a hydroxyl group or a sulfonamido group, and $R^2$, $R^3$, $R^5$ and $R^6$ each has the same meaning as given in formula [I];

[III]

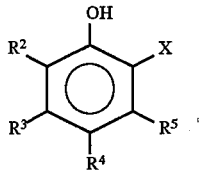

wherein X represents a hydroxyl group or a sulfonamido group, and $R^2$, $R^3$, $R^4$, $R^5$ and $R^6$ each has the same meaning as given in formula [I];

[IV]

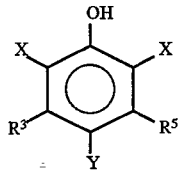

wherein X represents a hydroxyl group or a sulfonamido group, Y represents a carbamoyl group, an oxycarbonyl group, an acyl group or a sulfonyl group, and $R^3$ and $R^5$ each has the same meaning as given in formula [I];

[V]

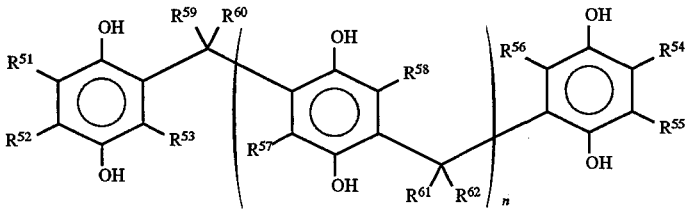

wherein $R^{51}$ to $R^{58}$ each has the same meaning as $R^2$ given in formula [I], $R^{59}$ to $R^{62}$ each represents a hydrogen atom, an alkyl group, an aryl group or a heterocyclic group, and n is an integer of 0 to 50.

5. The silver halide photographic material as claimed in claim 1, wherein $R_1$, $R_2$ and $R_3$ each represents an alkyl group, an aryl group, an alkoxyl group, an aryloxy group, an alkylthio group, an arylthio group, an acyloxy group, an amino group, an alkylamino group, a carbonamido group, a sulfonamido group, a ureido group, an oxycarbonyl group, a carbamoyl group, a sulfinyloxy group, a carboxyl group and a salt thereof, and a sulfo group and a salt thereof.

6. The silver halide photographic material as claimed in claim 1, wherein the compound represented by formula (A)

is represented by formula (C)

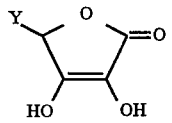

(C)

wherein Y represents a hydrogen atom or a group represented by formula (D)

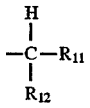

(D)

wherein $R_{11}$ and $R_{12}$ are the same or different, and each represents a hydrogen atom, an alkyl group, an alkoxyl group, an acyloxy group or an oxycarbonyl group.

7. The silver halide photographic material as claimed in claim 1, wherein the compound represented by formula (A) is represented by formula (E)

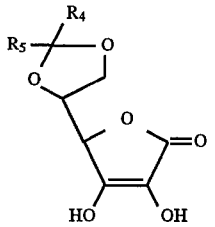

(E)

wherein $R_4$ and $R_5$ are be the same or different, and each represents a hydrogen atom, an alkyl group, an aryl group or an alkenyl group; and the alkyl groups represented by $R_4$ and $R_5$ may combine with each other to form a ring structure.

8. The silver halide photographic material as claimed in claim 1, wherein said at least one compound represented by formula [I] or (A) is a compound represented by formula (A).

9. The silver halide photographic material as claimed in claim 1, wherein said at least one compound represented by formula [I] or (A) is contained in said at least one silver halide emulsion layer or an adjacent layer thereof.

10. The silver halide photographic material as claimed in claim 1, wherein said at least one compound represented by formula [I] or (A) is contained in an amount of 0.01 to 10 mol per 1 mol of silver halide.

11. The silver halide photographic material as claimed in claim 1, wherein from 70% to 100% of the total projected area of said silver halide grains accounts for silver chloride-containing tabular grains having (i) a silver chloride content of 50 mol % to 100 mol % and (ii) a (100) face as a major face, and the tabular grains have an average aspect ratio of 5 to 20.

12. The silver halide photographic material as claimed in claim 1, wherein the coating amount of silver per one side of the support is 2.0 $g/m^2$ or less, and said at least on silver halide emulsion layers are formed on both sides of said transparent support.

13. The silver halide photographic material as claimed in claim 12, wherein the coating amount of silver per one side of the support is 0.5 to 1.8 $g/m^2$.

14. The silver halide photographic material as claimed in claim 1, which is used in combination with an X-ray absorbent fluorescent intensifying screen having an emission peak in an ultraviolet region.

15. The silver halide photographic material as claimed in claim 1, which is used in combination with an X-ray absorbent fluorescent intensifying screen having an emission peak between 540 nm and 555 nm.

* * * * *